United States Patent [19]

Ishiguro et al.

[11] Patent Number: 5,053,831

[45] Date of Patent: Oct. 1, 1991

[54] IMAGE FORMING APPARATUS HAVING A FINISHER

[75] Inventors: Kuniaki Ishiguro; Takuma Ishikawa; Akiyoshi Johdai; Hiroki Yamashita, all of Osaka, Japan

[73] Assignee: Minolta Camera Kabushiki Kaisha, Osaka, Japan

[21] Appl. No.: 311,842

[22] Filed: Feb. 17, 1989

[30] Foreign Application Priority Data

| | | | |
|---|---|---|---|
| Feb. 18, 1988 | [JP] | Japan | 63-35893 |
| Mar. 28, 1988 | [JP] | Japan | 63-75640 |
| Mar. 28, 1988 | [JP] | Japan | 63-75641 |

[51] Int. Cl.[5] ..... G03G 21/00

[52] U.S. Cl. ..... 355/324; 270/53; 355/243

[58] Field of Search ..... 355/324, 323, 313, 243, 355/56, 55; 270/37, 53; 271/287, 288

[56] References Cited

U.S. PATENT DOCUMENTS

| | | | |
|---|---|---|---|
| 3,944,207 | 3/1976 | Bains | 270/58 |
| 4,295,733 | 10/1981 | Janssen et al. | 355/313 X |
| 4,411,515 | 10/1983 | Kukucka et al. | 355/321 |
| 4,669,858 | 6/1987 | Ito et al. | 355/243 |
| 4,752,809 | 6/1988 | Ito | 355/243 X |
| 4,864,350 | 9/1989 | Ishiguro et al. | 355/323 X |

FOREIGN PATENT DOCUMENTS

| | | | |
|---|---|---|---|
| 0077458 | 5/1984 | Japan | 355/323 |
| 0239171 | 10/1987 | Japan | 355/313 |

*Primary Examiner*—A. T. Grimley
*Assistant Examiner*—Robert Beatty
*Attorney, Agent, or Firm*—Burns, Doane, Swecker & Mathis

[57] ABSTRACT

A copying machine having a sorter and a finisher is capable of operating in three different modes: a copying mode with sorting, a copying mode without sorting, and a stapling finish mode. When the stapling finish mode is selected, an automatic magnification selecting mode (AMS mode) is automatically chosen, wherein only copies of one size are made during the copying operation such that unsatisfactory stapling caused by copy sheets of differing size is prevented. Also, if one of a number of sorting bins of the copying machine is not being used while the copying machine is operating in the stapling finish mode, a copying operation can be carried out in the copying mode without sorting, utilizing that bin.

17 Claims, 34 Drawing Sheets

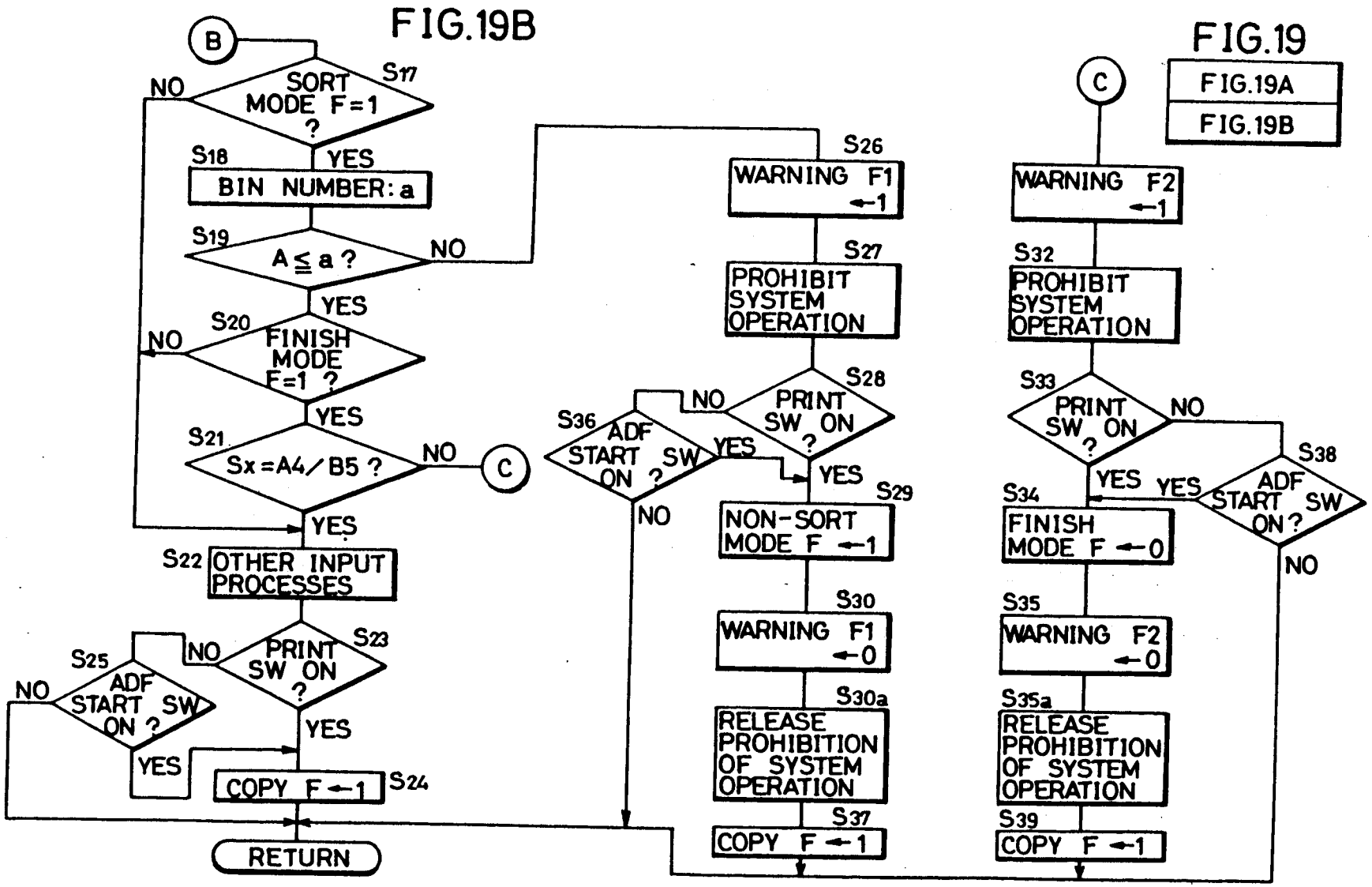
FIG.19
FIG.19A
FIG.19B
FIG.19B
B
C
S17
SORT MODE F=1 ?
YES
NO
S18
BIN NUMBER: a
S19
A ≦ a ?
S20
FINISH MODE F=1 ?
S21
Sx = A4 / B5 ?
S22
OTHER INPUT PROCESSES
S23
PRINT SW ON ?
S24
COPY F ←1
S25
ADF START SW ON ?
RETURN
S26
WARNING F1 ←1
S27
PROHIBIT SYSTEM OPERATION
S28
PRINT SW ON ?
S29
NON-SORT MODE F ←1
S30
WARNING F1 ←0
S30a
RELEASE PROHIBITION OF SYSTEM OPERATION
S36
ADF START SW ON ?
S37
COPY F ←1
S32
PROHIBIT SYSTEM OPERATION
S33
PRINT SW ON ?
S34
FINISH MODE F ←0
S35
WARNING F2 ←0
S35a
RELEASE PROHIBITION OF SYSTEM OPERATION
S38
ADF START SW ON ?
S39
COPY F ←1
WARNING F2 ←1

| |
|---|
| FIG.24A |
| FIG.24B |

| |
|---|
| FIG.25a(A) |
| FIG.25a(B) |

| |
|---|
| FIG.25b(A) |
| FIG.25b(B) |

IMAGE FORMING APPARATUS HAVING A FINISHER

BACKGROUND OF THE INVENTION

1. Field of the Invention

The present invention relates to an image forming apparatus having a finisher in which sheets of paper discharged from a copying machine or the like are distributed and stapled. More specifically, the present invention relates to an improved image forming apparatus having a finisher.

2. Description of the Related Art

Recently, in order to automatically handle sheets of paper in an image forming apparatus such as a copying machine, various optional devices such as an automatic document feeding apparatus (hereinafter referred to as an ADF) or a sorter for sorting and grouping copied or printed sheets have been developed and popularly used. One of such optional devices is a sorter having a finisher in which sheets of paper distributed and contained in a plurality of bins of a sorter are automatically stapled and stacked. Such sorter having a finisher has come to be used in some of the larger type copying machines.

In the conventional sorter having the finisher, one of the bins for sorting is used as a tray for normal copying in case where the finish mode is not selected. (Usually, the uppermost bin is used as the tray). When the machine is in the finish mode in which the stapling process is carried out, the sort bins are used for the stapling process. Therefore, the next copying operation, even when the copying machine is available for copying could not be executed until the end of the process in the finish mode.

Meanwhile, in the sorter having the finisher, the size of sheets for copying may be changed while the finish mode for the stapling process is selected and the image forming process is being carried out. In such case, even if the sheets of paper having the different sizes can be stapled, proper stapling process can not be carried out as the size of the sheets are various. Therefore, when the finish mode is successively selected, the stapling cannot be carried out in a satisfactory manner.

Now, image forming apparatuses having automatic magnification selecting function and automatic paper selecting function have been developed. The automatic magnification selecting function (hereinafter referred to as AMS) means a function for automatically setting the most suitable copying magnification rate at which the whole original images are properly formed on a sheet having the selected size and there is no possibility of some portions of the images being out of the paper, based on the size of the original (which is normally detected automatically in the ADF) and on the size of the sheet (in this case, selected by an operator). The automatic paper selecting function (hereinafter referred to as APS) means a function of automatically selecting a paper feeding portion containing sheets of paper whose size allows proper formation of original images at a selected copying magnification rate without the possibility of some portions of the images being out of the paper, based on the above mentioned size of the original and the copying magnification rate (in this case, selected by an operator).

Therefore, when originals having different sizes are set in the ADF at one time, the APS mode and the said finish mode are selected and the image forming process is carried out, then sheets of different sizes are selected and fed corresponding to the size of the originals to be transferred to the finisher. Consequently, the stapling process is carried out with the size of sheets being various.

SUMMARY OF THE INVENTION

Therefore, one object of the present invention is to provide an image forming apparatus having a finisher which is convenient for use.

Another object of the present invention is to enable, when an image forming process is finished, the next image forming process even in a finish mode in an image forming apparatus having a finisher.

A further object of the present invention is to prevent defective stapling process in a copying apparatus having a finisher.

A still further object of the present invention is to make best use of AMS and APS functions in a copying apparatus having a finisher.

The above described objects of the present invention can be attained by an image forming apparatus of the present invention comprising: means for forming images on sheets of paper; a plurality of paper containing means for receiving the sheets of paper on which the images are formed; sorting means for carrying out sorting process by distributing the sheets of paper on which the images are formed to the plurality of paper containing means; staple means for stapling sheets of paper contained in each of the plurality of paper containing means; conveyer means for conveying the sheets of paper contained in the paper containing means to the staple means after the end of the sorting process by the sorting means; stacking means for containing, in a stacked manner, the sheets of paper stapled by the staple means; determining mean for determining presence/absence of a paper containing means not employed for sorting process; and control means for permitting reception of the next sheet of paper to the unemployed paper containing means during the stapling process, when it is determined by the said determining means that there is an unemployed paper containing means.

As the image forming apparatus comprises the above described components, if any of the plurality of paper containing apparatuses is not used, the image forming apparatus is operated using that paper containing apparatus during stapling process, and the paper on which images are formed is contained in that unemployed containing apparatus. Therefore, in an image forming apparatus having a finisher carrying out the stapling process, when one image forming process is completed, the next image forming process can be carried out even in the stapling process. Therefore, an image forming apparatus having a finisher which is easily used by a user can be provided.

In accordance with another aspect of the present invention a copying apparatus with a photoreceptor capable of reproducing images from an original at different magnifications on sheets of paper comprises: original size detecting means for detecting the size of the original; paper size determining means for determining the size of the paper; magnification rate setting means for automatically setting a suitable copying magnification rate based on the original size and the paper size; staple means for stapling the sheets of paper on which the image is formed; wherein the copying apparatus is operated either in a staple mode in which stapling is carried out by the staple means or in a non-staple mode in which the stapling is not carried out; and the copying apparatus further comprises means for switching between the staple mode and the non-staple mode; and control means for changing the copying magnification rate based on a set value of the magnification rate automatically setting means when the staple mode is selected by the switching means.

The copying apparatus in accordance with this aspect of the present invention comprises the above described components. When the copying apparatus is operated in the staple mode, control means controls the magnification rate automatic setting means such that the copying is carried out at a magnification rate at which copies are provided on sheets of papers having the same suitable size. Consequently, the sheets of paper to be stapled have the same size. Consequently, a copying apparatus having a finisher can be provided in which defective stapling process can be prevented.

According to a further aspect of the present invention, a copying apparatus with a photoreceptor having a capability of reproducing an image from an original at different magnifications on paper comprises: original size detecting means for detecting the size of the original; paper size determining means for determining the size of the paper; copying magnification rate setting means for automatically setting a suitable copying magnification rate based on the original size and the paper size; staple means for stapling sheets of paper on which the image is formed; wherein the copying apparatus is operated either in a staple mode in which stapling is carried out by the staple means or in a non-staple mode in which stapling is not carried out; the copying apparatus further comprises magnification rate determining means for determining whether or not the magnification rate set by the copying magnification rate setting means is in an available range of the magnification rate; and means for prohibiting operation of the staple means when it is determined by the magnification rate determining means that the set magnification rate is out of a prescribed available range of the magnification rate.

In accordance with the further aspect of the present invention, the copying apparatus comprises the above described components. When it is determined that the set magnification rate is out of a prescribed available range of the magnification rate while the copying apparatus is operated in the staple mode, the stapling operation is prohibited. Therefore, there is no possibility of a defective copy, in which some portions of the images are out of the copy paper, being stapled with other properly copied sheets. Consequently, a copying apparatus having a finisher capable of making best use of the AMS function, APS function and the like is provided.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 13, 14 and 15 are plan views of operation panels; an

DESCRIPTION OF THE PREFERRED EMBODIMENTS

One embodiment of an image forming apparatus having a finisher in accordance with the present invention will be described in the following, taking a copying apparatus having a sorter with finisher as an example, with reference to the appended drawings.

Whole Structure

Figure 1:
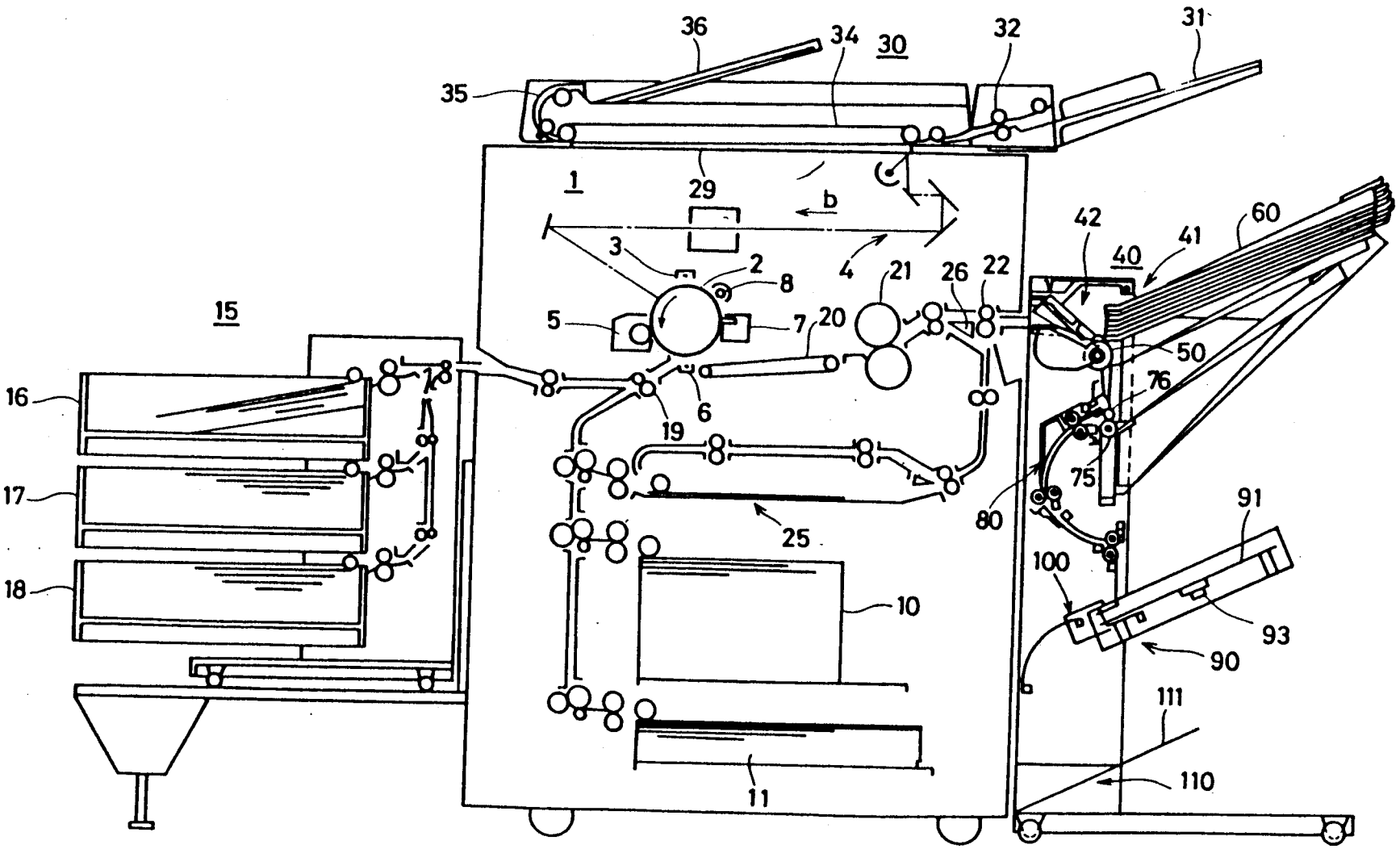
FIG. 1 is a schematic diagram of the whole apparatus.

Referring to FIG. 1, a copying apparatus having a sorter with finisher comprises a copying machine 1, a sorter 40 having a finisher provided on a side portion of the copying machine 1, an automatic paper feeding apparatus 15 provided on the opposite side of the copying machine 1 and an automatic document feeding apparatus 30 (hereinafter referred to as an ADF) provided on an upper portion of the copying machine 1. The copying machine 1 provides copies in accordance with a known electrophogographic method. Prescribed charges are applied by means of a corona charger 3 to a photoreceptor drum which is rotary driven in the direction of the arrow a, and an original set at a prescribed position by means of the ADF 30 is exposed slitwise by scanning of an optical system 4 in the direction of the arrow b. Consequently, latent electrostatic images formed on the photoreceptor drum 2 are turned into toner images by a magnetic brush type developing apparatus 5, and are transferred onto a sheet by means of a transfer charger 6.

Sheets of paper are selectively fed one by one from any of the elevating type and cassette type automatic paper feeding apparatuses 10, 11 in the copying machine 1 and three stages of paper feed cassettes 16, 17 and 18 of an automatic paper feeding apparatus 15 externally provided to the machine, and the sheet of paper is transferred to the transferring portion at a prescribed timing by means of a timing roller pair 19. The sheet on which the images have been transferred is fed to a fixing apparatus 21 by means of conveyer belt 20 where toner images are fixed, and the sheet is fed into a sorter 40 through a discharging roller pair 22. A passage of a sheet on which images are fixed can be detected by means of a discharging switch SW3 (see FIG. 2) provided in the upstream side of the discharging roller pair 22. The copying machine 1 contains a paper refeeding apparatus 25 for providing a duplex copy or a composite copy. A pawl for switching the direction of conveying the sheet is provided in the upstream side of the discharging roller pair 22.

Meanwhile, the rotation of the photoreceptor drum 2 is continued in the direction of the arrow a after the images are transferred. A blade type cleaning apparatus 7 removes remaining toner on the photoreceptor drum 2, and an eraser lamp 8 erases remaining charges thereon, so that the machine is ready for the next copying operation.

Further, size detecting switches (not shown) are provided in the automatic paper feeding apparatuses 10, 11 and 15 for detecting the size of the sheets contained therein. These size detecting switches are operated by a projection or a magnet provided in each cassette. The switches detect the size of the sheet by using prescribed on, off signals to output the result to a microcomputer for control. The size detecting switches also detect the direction of arrangement of the sheets, namely, whether the longer side of each sheet is parallel to the direction of conveying the sheet or orthogonal to the direction of conveying the sheet.

The ADF 30 is known per se, which feeds one by one the originals placed on a document tray 31 by means of a paper feed roller pair 32 and sets the document on a prescribed position of a platen glass 29 by the rotation of the conveyer belt 34. After the images are exposed, the document is discharged onto a discharging tray 36 through a reverse conveying pass 35 by the rotation of the conveyer belt 34.

A plurality of sensors SE are provided in the ADF 30 for detecting the size of the document fed from the document tray 31. The width of each of the documents is detected by the sensor, the length of each original is detected by a combination of the sensors and a timer, and the detected width and length are outputted to a microcomputer for control. The detailed description is omitted, since it is disclosed in U.S. Pat. No. 4,669,858, and so on.

Figure 2:
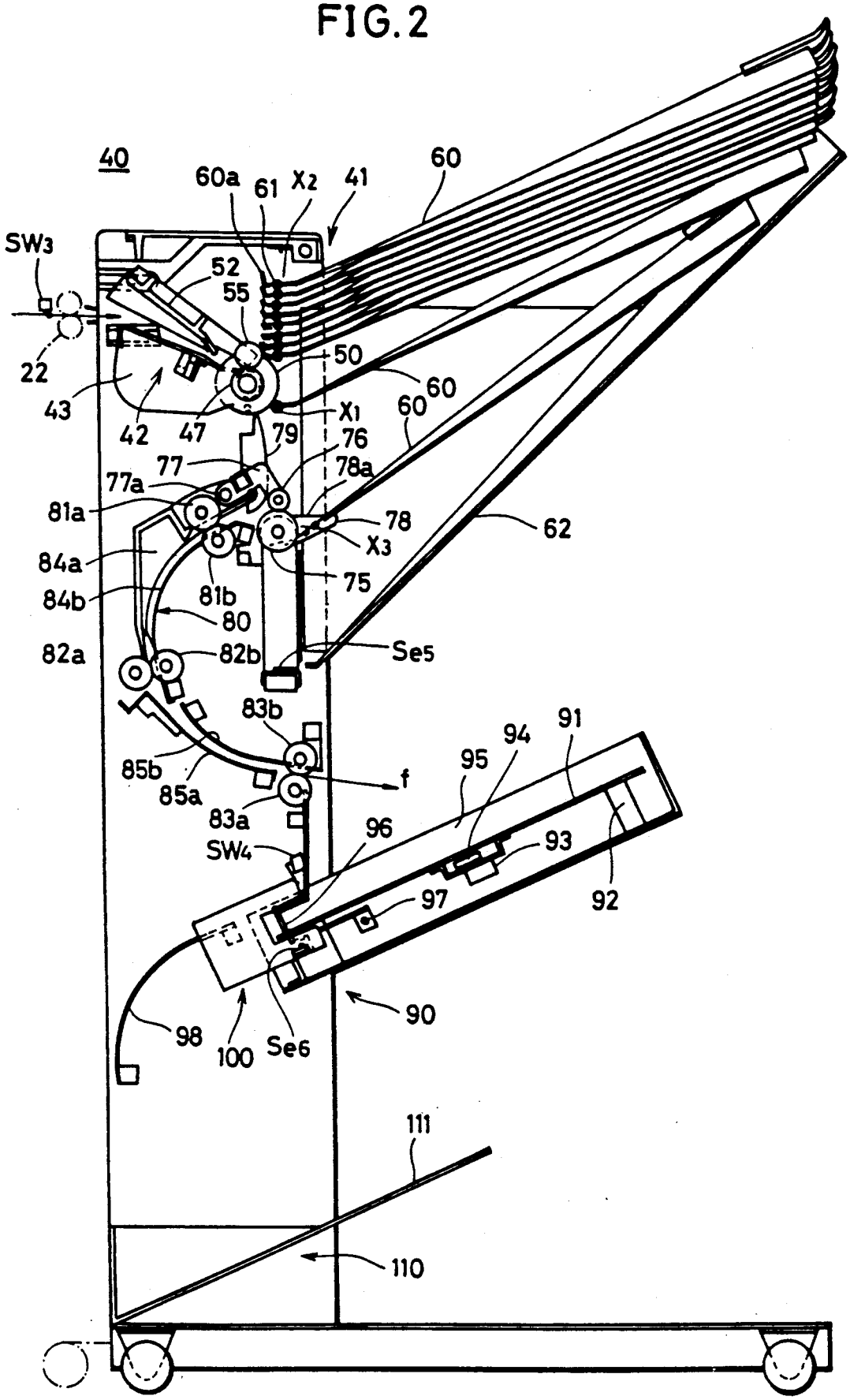
FIG. 2 is a diagram showing an internal structure of a sorter having a finisher.

The sorter 40 comprises a sorter portion 41 for distributing sheets to respective bins 60, a staple portion 90 having a stapler 100 for stapling the sheets, and a stack portion 110 for stacking and containing the stapled sheets, as shown in FIG. 2. The staple portion 90 is positioned below the sorter portion 41 and the stack portion 110 is positioned below the staple portion 90.

AMS, APS

The copying machine 1 is capable of carrying out copying operations in the automatic magnification selecting mode and in the automatic paper selecting mode. In the AMS mode, the most suitable copying magnification rate is automatically set, at which rate the images of the original are properly formed in a satisfactory manner on a selected sheet without some portions of the images being out of the paper, based on the size of the original detected by the ADF 30 and on the size of the sheet selected by an operator. In this case, sheets of paper having the same size are fed. In the APS mode, a paper feeding portion containing the sheets of paper, whose size allows formation of the images at a selected copying magnification rate without a possibility of some portions of the original being out of the paper, is automatically selected based on the size of the original detected by the ADF 30 and on the copying magnification rate selected by an operator, the sheets are fed and the copying operation is carried out. In this case, sheets of different sizes may be fed. Therefore, in this embodiment, when the ADF 30 is employed and the finish mode, in which the stapling process, which will be described later, is selected, the AMS mode is automatically selected.

Structure and Operation of the Sorter Portion

Figure 3:
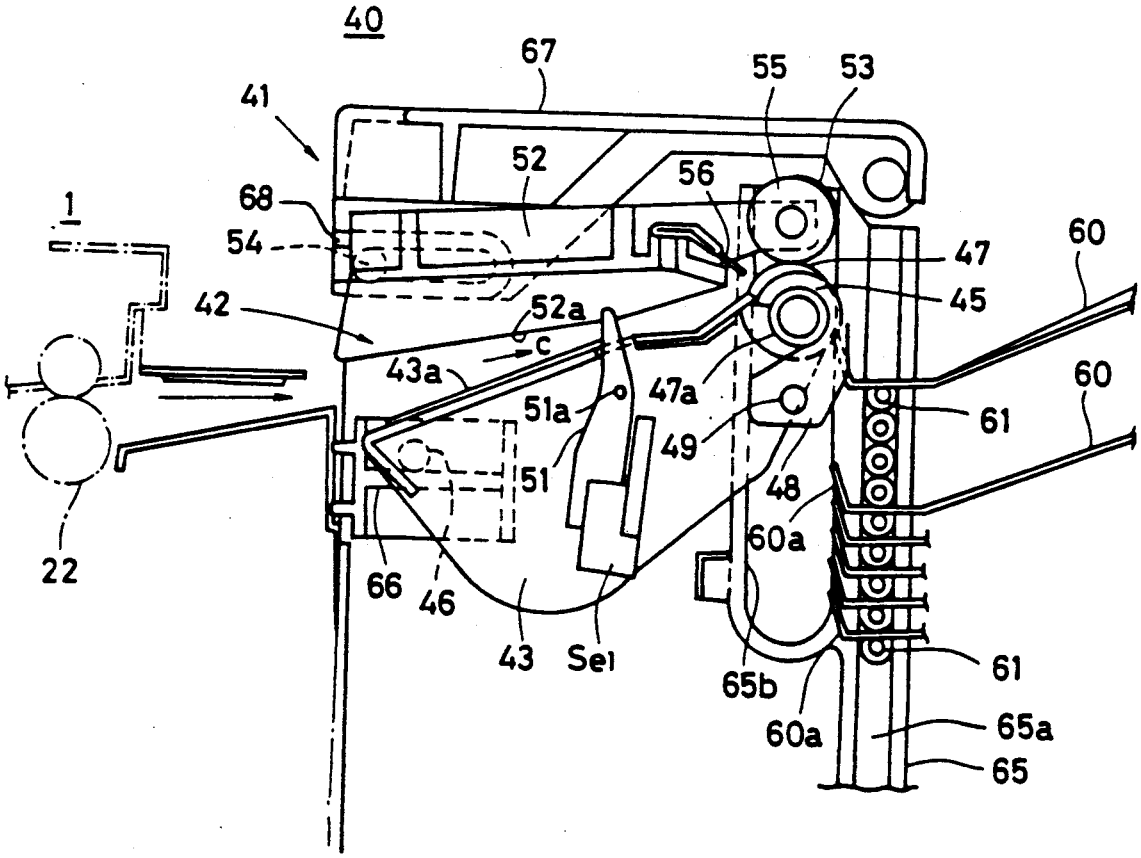
FIG. 3 is a vertical cross sectional view of the sorter portion.

As shown in FIGS. 2 and 3, each of a plurality of bins 60 comprises a pawl **60*a* for preventing feeding of the sheet in the reverse direction provided on the side of the sorter portion 41 and trunions 61 projecting laterally. The movement of the bin 60 in the upward and downward direction is limited by means of the trunion 61 engaged in a groove 65*a* extending in the upward and downward direction on a guide unit 65 attached to a frame of the sorter 40. Each of the bins 60 is supported being placed on a bin supporter 62. The spaces between each of the bins can be made wider by shifting the trunions 61 in association with rotation of a floating cam 50**, which will be described later.

In the sorter portion 41, the sheet conveying portion 42 opposing to the discharging roller pair 22 of the copying machine 1 and the bins 60 are relatively moved in the vertical direction, so that the sheets discharged from the copying machine 1 are distributed into respective bins 60. The sheet conveying portion 42 comprises an upper unit 62 having a guiding surface **52*a*, a lower unit 43 having a guiding surface 43*a*, a feeding roller 47 and a pinch roller 55. The sheets pass through a space between the guiding surfaces 52*a* and 43*a* to be distributed to the respective bins 60 through the rollers 47 and 55**.

Figure 4:
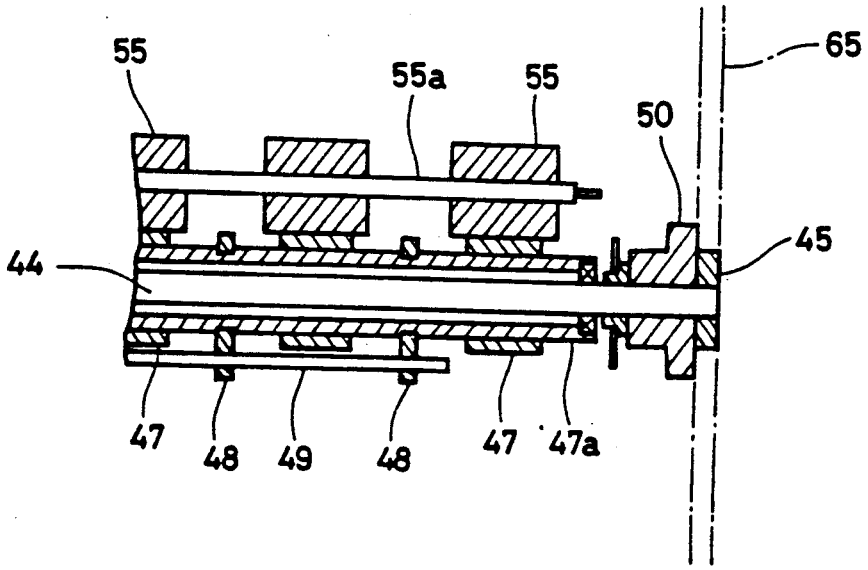
FIG. 4 is a horizontal cross sectional view of a feeding roller portion of the sorter portion.
Figure 5:
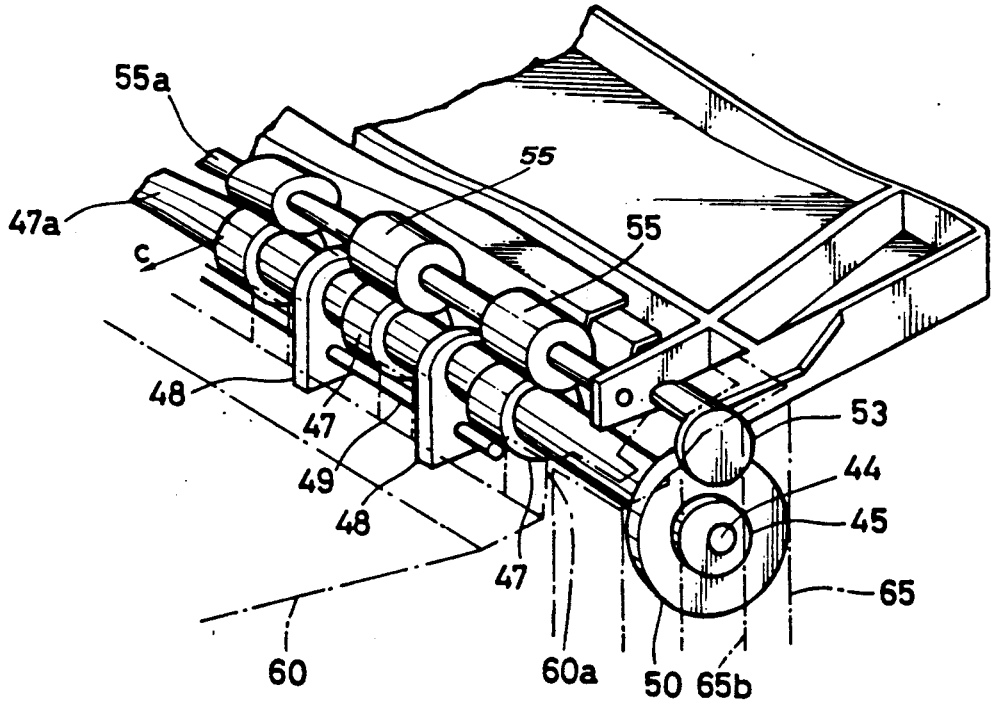
FIG. 5 is a perspective view of a conveying portion.

The roller unit 43 is supported by a supporter axis 44 provided orthogonal to the direction of conveying the sheet (represented by the arrow c) at an end portion on the side of the bins 60. Namely, referring to FIGS. 4 and 5, by engaging both ends of the support axis 44 with rail portions **65*b* provided on a guide unit 65 through collars 45, the lower unit 43 is made swingable in the upward and downward directions and, in addition, it is made slidable in the horizontal direction by the pin 46 provided on the side of the copying machine supported by a guiding member 66**.

Figure 6:
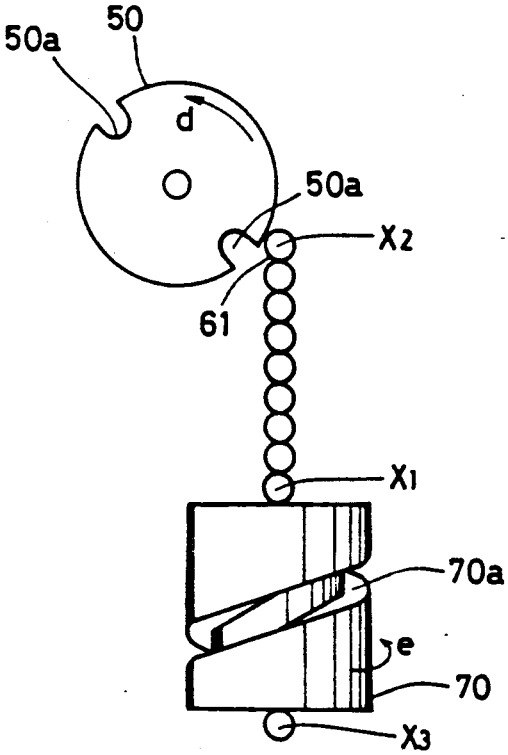
FIG. 6 illustrates a flowing cam and a spiral cam.
Figure 7:
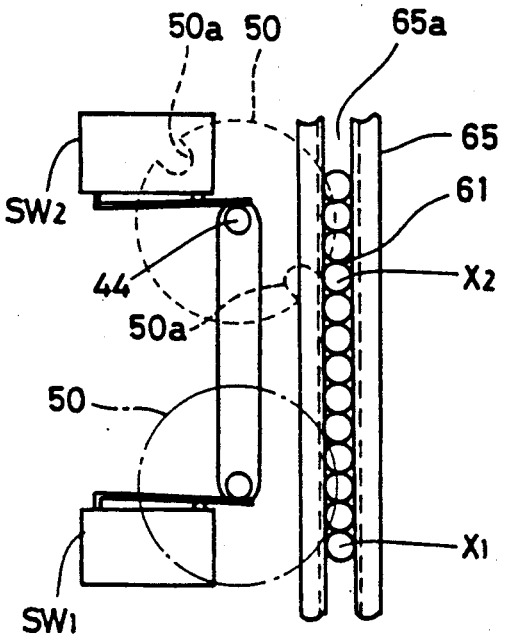
FIG. 7 illustrates a flowing cam.

A roller axis **47*a* on which a plurality of feeding rollers 47 are fixed is rotatably attached to the support axis 44, and swing plates 48 are suspended from the roller axis 47*a*. The swing plates 48 are coupled with each other by a rod 49 with a lower portions of the plates positioned between the pawls 60*a* for preventing reversal feeding of the said bins 60. In addition, floating cams 50 each having notches 50*a*, 50*a* provided spaced apart from each other by 180° on the outer periphery thereof are fixed on both ends of the support axis 44, as shown in FIGS. 6 and 7. Each of the floating cams 50 is rotary driven intermittently by 180° by means of a driving source which is different from the one for driving the feeding roller 47, and the floating cams support the lower unit 43 as well as the rear ends of the bins 60, as the trunions 61 are in contact with the outer periphery. The floating cams 50 are movable upward and downward to and from the bottom bin position $X_1$ and a top bin position $X_2$ as shown in FIG. 7. Switches SW1 and SW2 provided at the respective positions detect the position of the floating cams 50. In addition, as shown in FIG. 3, the lower unit 43 comprises an actuator 51 which is rotatable about a pin 51*a* and a photosensor Se1 which is turned on/off by the rotation of the actuator 51** in contact with the sheet conveyed.

Meanwhile, the upper unit 52 is swingable in upward and downward direction as an engaging piece 53 on the side of the bins 60 is engaged with the rail portion **65*b*, and it is slidable in the horizontal direction as a pin 54 provided on the side of the copying machine 1 is engaged with a guiding member 68 provided on an upper lid 67 of the sorter 40. A pinch roller 55 is rotatably attached to the upper unit 53 by means of a support axis 55*a*, and an electrostatic cleaner for removing charges on the sheet conveyed is provided in this upper unit 53. The pinch roller 55 is rotatably driven by the weight of itself, being in contact with the feeding roller 57**.

A transmitting type photosensor Se5 (see FIG. 2) whose optical axis positioned at the rear end of each of the bins 60 is provided in the sorter portion 41 to detect presence/absence of distribution of the sheets to each of the bins 60.

In the above described structure, each of the floating cams 50 is rotated by 180° in the direction opposite to the arrow d (see FIG. 6) so that the trunion 61 is engaged with the notch 50*a*, and the floating cam itself moves upward. At the same time, the trunion 61 which is in the notch is shifted downward, and the cam comes into contact with the next trunion 61. By repeating this operation, each of the bins 60 is shifted downward one by one, and the conveying portion 42 moves upward. When the finish mode is selected and the sorting of the sheets is carried out as will be described later, the floating cam 50 is placed at the bottom bin position $X_1$ shown in FIG. 7, and it gradually moves upward from this position to widen the spaces between respective bins 60. The sheets discharged from the copying machine 1 pass through a space between the guiding surfaces 52*a* and 43*a*, sandwiched by the feeding roller 47 and the pinch roller 55 and distributed and contained one by one in each of the bins 60 starting from the lower most bin 60, with the spaces between respective bins widened by means of the floating cam 50. The floating cam 50 shifts the bins 60 successively upward when it is rotated in the direction of the arrow d (see FIG. 6), and the cam itself moves downward together with the conveying portion 42.

In the sorter portion 41 structured as described above the sheets can be contained in three different modes. The first mode is a sort mode in which one copy of one original is distributed in each bin 60, and the copies are collated in each bin. The second mode is a grouping mode in which all copies of one original are distributed to one bin 60. The third mode is a non-sort mode in which copies of the originals are not distributed but all contained in one bin 60. When the operation is in the non-sort mode, the said floating cam 50 is placed at the top bin position $X_2$, and the sheets are contained in the uppermost bin 60.

Structure and Operation of a Spiral cam

A spiral cam 70 and a conveying portion 80 for conveying the distributed sheets contained in respective bins 60 to the staple tray 91 will be described in the following.

Figure 8:
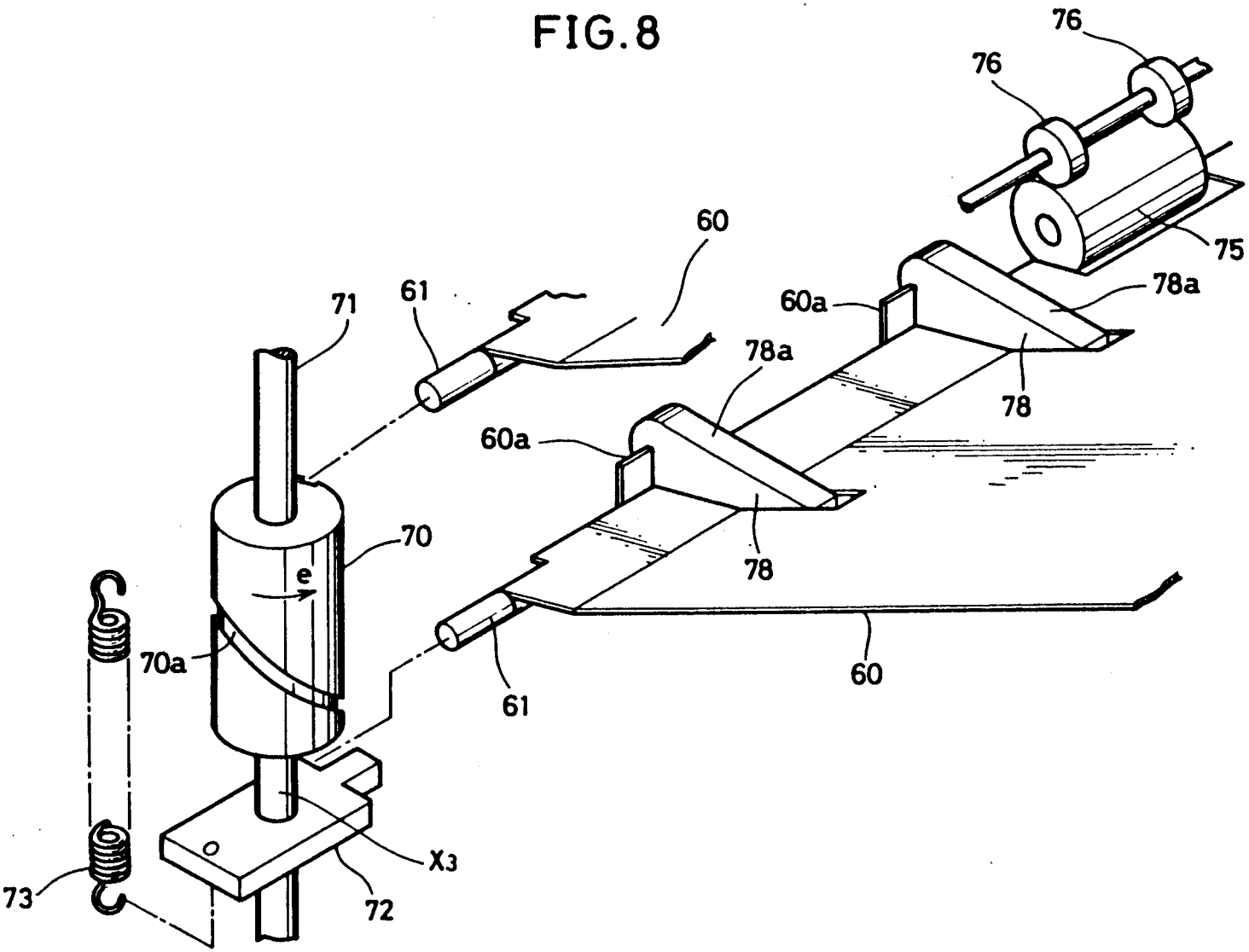
FIG. 8 is a perspective view of a portion for taking out copied sheets.
Figure 9:
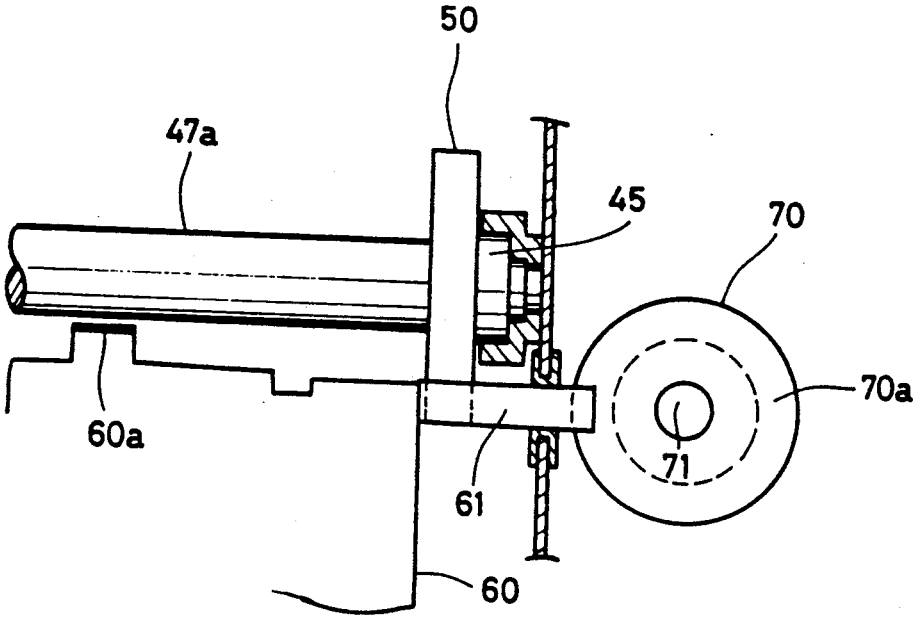
FIG. 9 is a side view showing an engagement between a trunion and the spiral cam.

As shown in FIGS. 6 and 8, the spiral cam 70 has a spiral groove 70*a* provided on the outer periphery, in which the said trunion 61 can be engaged. The spiral cam is rotatable in the forward and reversal direction by means of a motor, not shown , through a support axis 71. More specifically, when the spiral cam 70 is rotated in the direction of the arrow e, the trunion 61 of the bin 60 shifted to the bottom bin position $X_1$ by the floating cam 50 is guided by the spiral groove 70*a* to be lowered to a position $X_3$ where the sheets are taken out.

At the position $X_3$, a receiving member 72 is provided on the support axis 71 as shown in FIG. 8, with the member movable in upward and downward direction and being biased upward by a coil spring 73, so that the receiving member holds the trunion 61 in the position $X_3$ where the trunion 61 is forcingly brought into contact with the under surface of the spiral cam 70. At this position $X_3$, a taking roller 75, a pinch roller 76 being in contact with the roller 75 by the weight of itself and a sheet guide 78 are provided. A guide 79 for preventing reverse feeding of the sheets is provided between the bottom bin position $X_1$ and the taking position $X_3$, as shown in FIG. 2. The sheet guide 78 is provided such that the upper guiding surface 78*a* is a little higher than a pawl 60*a* for preventing reversal feeding of the sheets provided at an end portion of each bin 60 inclined and lowered to the taking position $X_3$, as shown in FIG. 8. The pinch roller 76 is rotatably supported by a support axis 77*a* by means of an arm 77, as shown in FIG. 2, and it can be attached to and detached from the taking roller 75 by turning on/off a solenoid, not shown.

Figure 10:
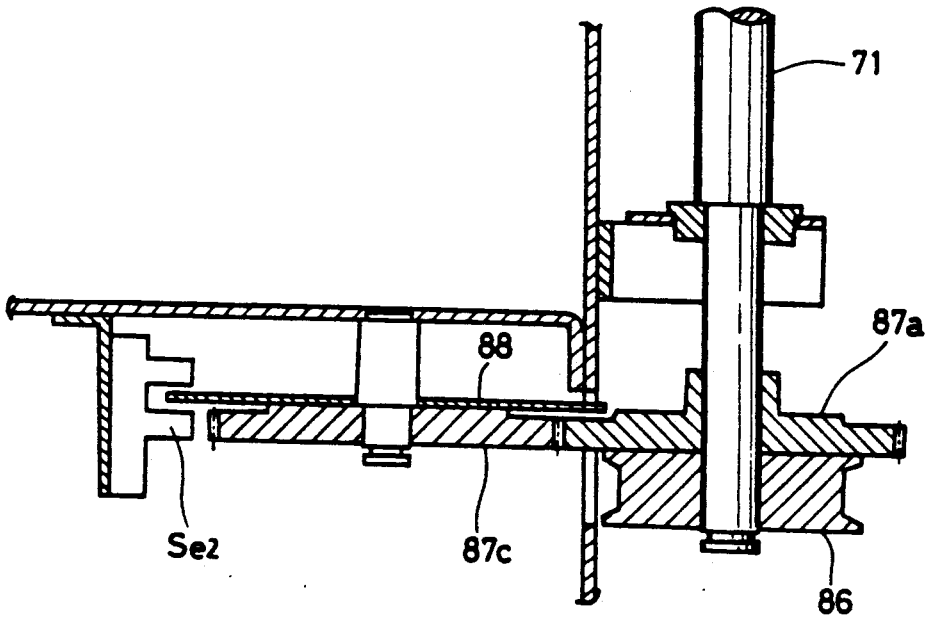
FIG. 10 is a vertical cross sectional view showing a rotation detecting portion of the spiral cam.

A pulley 86 and a gear 87*a* for driving are integrally fixed on the lower end of the support axis 71 of the spiral cam 70 as shown in FIG. 10, with the gear 87*a* engaged with a gear 87*c*, and the gear 87*c* integrally rotatable with a disk 88. A notch, not shown, is provided on the disk 88, and the notch is detected by a photosensor Se2 to enable control of the number of rotation of the spiral cam 70.

The conveying portion 80 comprises rollers 75, 76, conveying rollers 81*a*, 81*b* to 83*a* and 83*b*, and guiding plates 84*a*, 84*b*, 85*a* and 85*b*, as shown in FIG. 2. The conveying rollers 81*a*, 82*a* and 83*a* are formed of rubber, while the conveying rollers 81*b*, 82*b* and 83*b* are formed of sponge, so as to meet the thickness of the stacked sheets.

In the above structure, when the distribution of the sheets is completed in the sorter portion 41, the spiral cam 70 is rotated once in the direction of the arrow 3. Consequently, the trunion 61 of the bin 60 placed at the bottom bin position $X_1$ is guided by the spiral groove 70*a* to be lowered to the taking position $X_3$ and is received by the receiving member 72. At this taking position $X_3$ for taking the sheets out, the bin 60 is inclined by an angle larger than that at the bottom bin position $X_1$, so that the distributed and contained sheets slide downward while being guided by the guiding surface 78*a* of the guide 78 by the weight of the sheets themselves As shown in FIG. 8, the taking roller 75 is overlapped with the bin 60, and the end portion of the sheet is sandwiched between the rollers 75 and 76 when the bin 60 reaches the position $X_3$. The sheet is transferred to the conveying rollers 81*a* and 81*b* by the rollers 75 and 76. The sheet is surely transferred to the guiding plates 84*a* and 84*b* over the pawl 60*a* for preventing reversal feeding, even if the sheet is curled downward, since it is guided by the guide and the taking roller 75. Even if the sheet is curled upward, it is transferred to the guide plates 84*a* and 84*b* as it is guided by the guide 79 for preventing reversal feeding.

When the sheet is sandwiched and transferred by the rollers 81*a* and 81*b*, a solenoid, not shown, is turned off, so that the pinch roller 76 is moved upward (to the initial state) from a position on the taking roller 75. When the bin 60 reaches the position $X_3$ where the sheets are taken out, the solenoid is turned on, so that the sheet is sandwiched by the pinch roller and the taking roller 75, as described in the foregoing. Now, the taking roller 75 and the conveying rollers 81*a*, 81*b*, 82*a* 82*b*, 83*a* and 83*b* are respectively driven at this time so that the sheet is fed from the conveying rollers 83*a*, 83*b* to the staple tray 91 as shown by an arrow f in FIG. 2.

In this embodiment, a space between the bottom bin position $X_1$ and the taking position $X_3$, that is, the stroke of the bin 60 moving to and from these positions, is selected to be large in order to increase the angle of inclination of the bin 60 lowered to the taking position $X_3$, so that the sheet easily slides by the weight of itself. As described in the foregoing, each of the bins 60 is lowered one by one to the taking position $X_3$ at every rotation of the spiral cam 70, and the sheets distributed in each of the bins 60 are transferred to the staple tray 91 through the conveying portion 80.

Now, each of the bins 60 lowered to the position $X_3$ is supported by a receiving member 72 while it is biased upward. After all sheets are taken out from all of the bins 60 containing the sheets, the spiral cam 70 is reversely driven in the direction opposite to the arrow e and the floating cam 50 is driven in the direction of the arrow d, so that each of the bins 60 returns upward.

Structure and Operation of the Staple Portion

The staple portion 90 comprises a staple tray 91, a motor 93 for vibrating the tray, a guiding plate 95, a stopper 96 and a stapler 100, as shown in FIG. 2. The staple tray 91 is swingable about a support axis 92, and it is vibrated by centrifugal force of an eccentric weight 94 when the weight 94 is rotated by the motor 93. The sheets transmitted from the conveying portion 80 are aligned by this vibration while the sheets being regulated by the guiding plate 95 and the stopper 96.

The stapler 100 comprises an arm 104 swingable about a pin 103, a cam 102 provided at an end of the arm 104 and is rotatable about a fixed motor output axis 101, and a swingable head 105 provided on the other end of the arm 104. When the cam 102 rotates in the direction of the arrow g by a motor, the head 105 moves upward through the arm 104, and a staple 106 conveyed to a prescribed position by a conveyer belt 108 staples the sheets aligned on the tray 91. By the upward movement of the head 105, the staple 106 which is a line in a direction vertical to the surface of the sheets is transformed into a c shape with the opening facing upward to be in contact with the sheets. The staples 106 are contained in a cartridge 107 and they are transmitted to the head portion by the conveyer belt 108 which is rotary driven by the motor output axis 101.

Referring to FIG. 2, the stopper 96 can be rotated by a solenoid, not shown, about a support axis 97, and it is normally positioned at a lower end of the staple tray 91 to position the edge of the sheet. When the solenoid is turned on, the stopper 96 is moved downward to cancel the positioning of the sheet.

Figure 11:
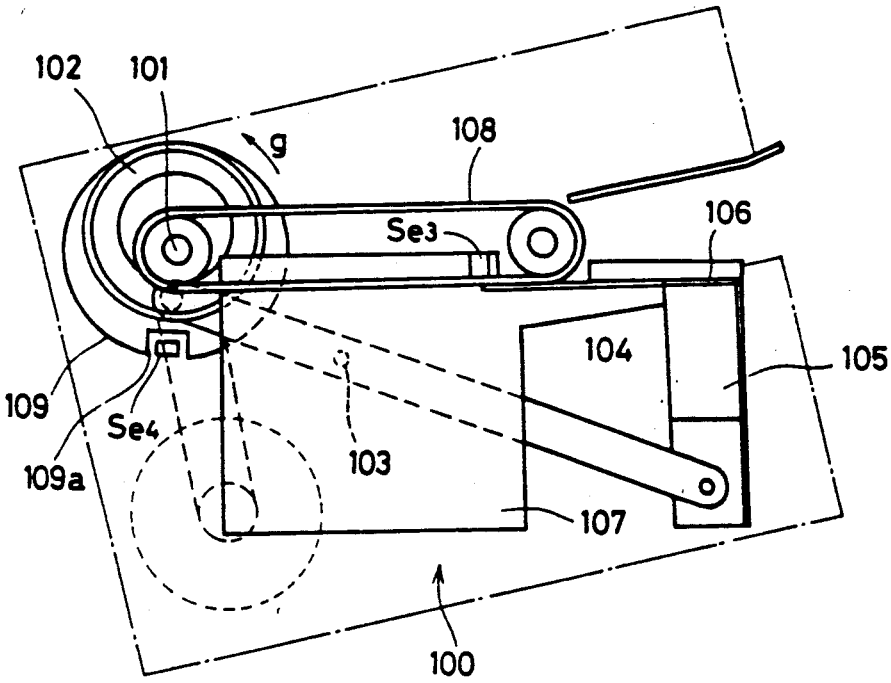
FIG. 11 is a plan view of a stapler.
Figure 12:
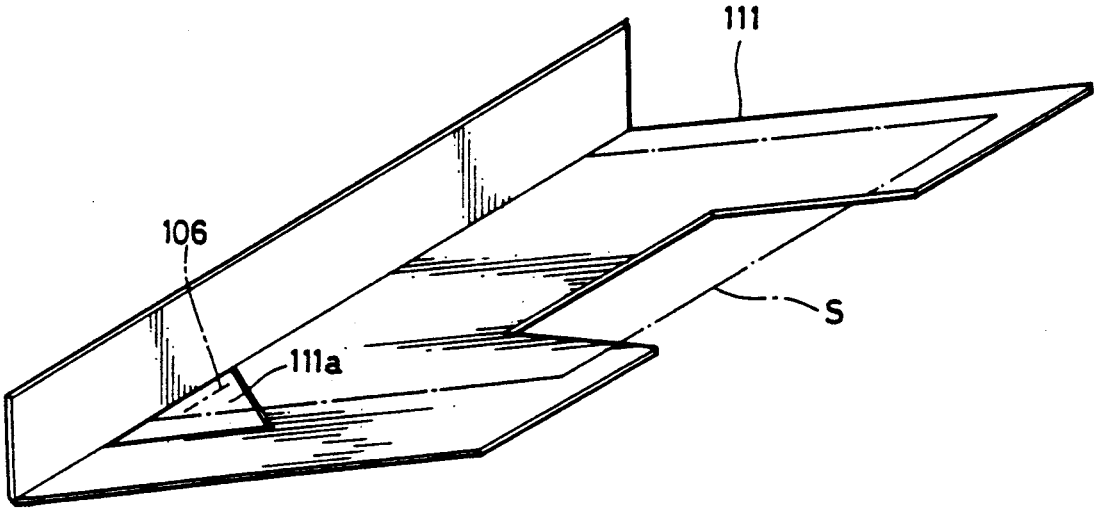
FIG. 12 is a perspective view of a stack tray.

Referring to FIG. 11, the stapler 100 comprises a photosensor Se3 for detecting absence of the staples 106 and a sensor Se4 for detecting the number of rotation of the staple motor. The sensor Se3 detects the staples 106 themselves, and the sensor Se4 detects a notch 109*a* of a disk 109 fixed on the motor output axis 101.

In the staple portion 90, a photosensor Se6 for detecting presence/absence of a sheet on the staple tray 91 and a switch SW4 for detecting attachment/detachment of the stapler are provided, as shown in FIG. 2.

In the above structure, the sheets conveyed from the conveying portion 80 to the staple tray 91 are aligned by the vibration of the tray 91 caused by the rotation of the motor 93, with the sheets regulated by the guiding plate 95 and the stopper 96. When the motor 93 is stopped, the staple motor is driven to staple the sheets. The stapled sheets slide downward from the tray 91, guided by the guiding plate 98 to be contained in a stack tray 111, as the stopper 96 is displaced from the tray 91 when the solenoid is turned on. This stapling process is repeated every time each of the said bins 60 is lowered to the taking position $X_3$ by means of the spiral cam 70 and the sheets are conveyed to the staple tray 91.

The detection of the absence of the staples may not necessarily be carried out by the sensor Se3. More specifically, during the stapling operation, the said sensor Se4 detects the number of rotation of the staple motor. When the staples 106 are exhausted and the head 105 operates without the staple, the torque is reduced and the number of rotation of the motor is increased. Therefore, the absence of the staple 106 can be detected based on the increase of the number of rotation.

Structure of the Stack Portion

The stack portion 110 shown in FIGS. 1 and 2 comprises a stack tray 111 in which the sheets stapled by the stapler 100 are contained in a stacked manner. A reflection type photosensor, not shown, is provided on the rear surface of the stack tray 111 to detect the presence/absence of the sheets on the tray 111. A notch 111*a* is formed on a portion of the stack tray 111 which portion corresponds to the stapled portion of the sheets S. By the provision of this notch, the stapled portion is located at the notch by the weight of itself when the sheets stapled by the stapler 100 are contained in the tray 111, so that the height of the stapled portions is regulated, increasing the capacity of the tray.

The same effect can be provided by providing a recess instead of the notch 111*a*.

Operation Panel

Figure 13:
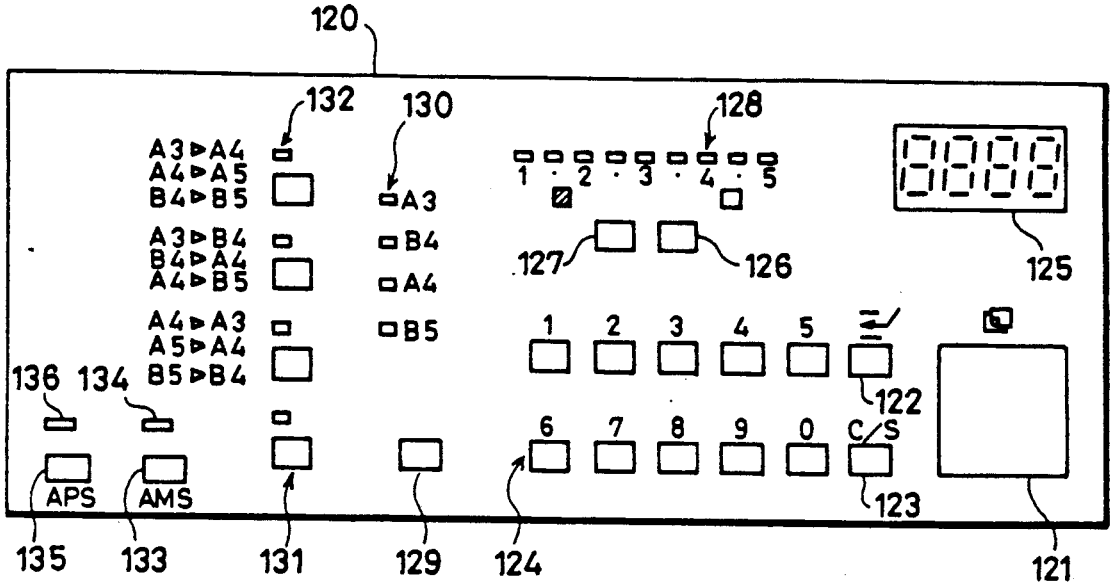
Figure 14:
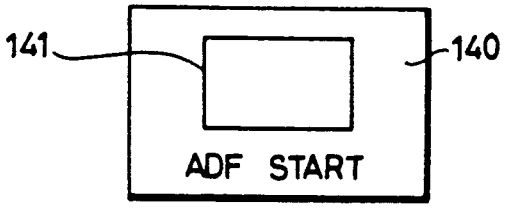
Figure 15:
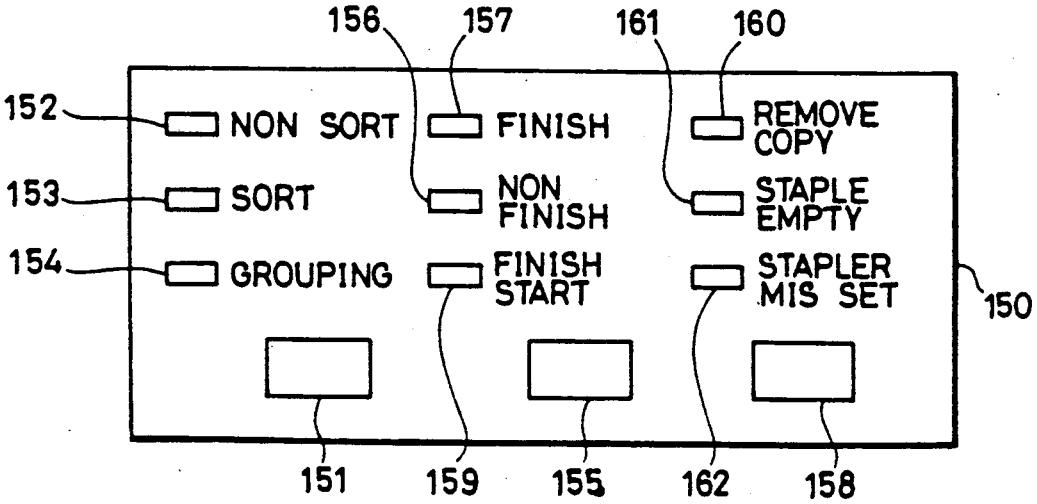

In the present embodiment, three operation panels are provided, i.e., on a copying machine panel 120, an ADF panel 140 and a sorter panel 150, as shown in FIGS. 13, 14 and 15, respectively.

On the copying machine panel 120 provided are: a print key 121 for starting the copying operation when the ADF 30 is not used; an interruption key 122 for temporarily stopping the multicopy operation; a clear/-stop key 123 for stopping the copying operation and for cancelling the set number; a ten key group 124 for setting the number of multiple copies; a display portion 125 for displaying the number of copies and the states of the copying machine 1; up and down keys 126 and 127 for setting copying density and a corresponding LED group 128 for displaying the density; a sheet selection key 129 for selecting the size of the copy sheets and a corresponding group of LEDs 130 for displaying the size; a magnification rate selecting key group 131 for selecting copying magnification rate and a corresponding group of LEDs 132 for displaying the magnification rate; an AMS mode selecting key 133 and a corresponding LED 134 for displaying the selection; an APS mode selecting key 135 and a corresponding display LED 136 for displaying the selection; and so on.

A start key 141 alone is provided in the ADF panel 140 to start the ADF operation. When this start key 141 is turned on, the originals on the original tray 31 are successively and automatically transmitted onto a platen glass 29, and the copying operation is started.

On the sorter panel 150 provided are; a sorter mode selecting key 151 and a non-sort mode displaying LED 152, a sort mode displaying LED 153 and a grouping mode display LED 154 which are the displaying portion corresponding to the key 141; a finish mode selecting key 155 and a non-finish mode displaying LED 156 and a finish mode displaying LED 157 which are the displays corresponding to the key 155; and a finish start key 158 and the displaying LED 159 corresponding to the key 158. When the LED 159 is on, it means that the finishing operation is being carried out. When the LED 159 is flickered, it is a warning that the sheets must be removed from the staple tray 91. On the sorter panel 150, an LED 160 for giving a warning to remove sheets from the bin 60, an LED 161 indicating the absence of the staple 106 and an LED 162 for indicating defective setting of the stapler 100. The non-sort mode, the sort mode and the grouping mode can be switched in this order at every pressing of the sorter mode selecting key 151, and the corresponding one of the LEDs 152, 153 and 154 is turned on. The non-finish mode and the finish mode can be switched between each other by every pressing of the finish mode selecting key 155, and the corresponding one of the LEDs 156 and 157 is turned on. Every time the finish start key 158 is pressed, the start or the cancel of the finish process is alternately outputted and the LED 159 is turned on when the start is outputted.

Control Circuit

Figure 16:
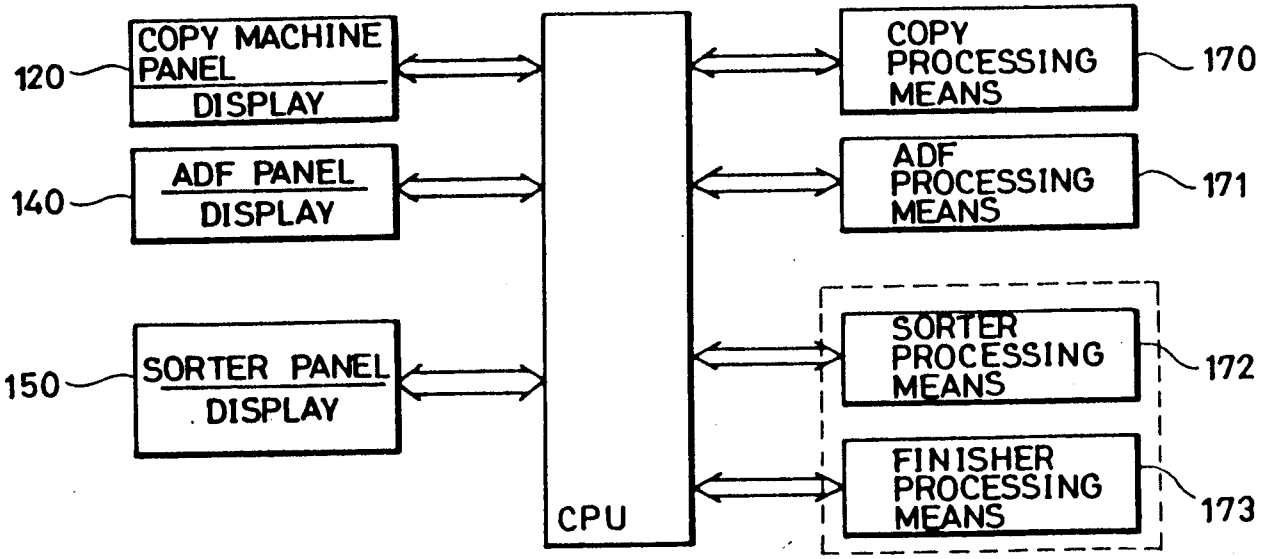
FIGS. 16 to 30 are flow charts respectively showing control processes.

FIG. 16 is a block diagram of a control circuit in which the copying machine panel 120, the ADF panel 140 and the sorter panel 150 are connected to a microcomputer CPU, and further, copy process means 170, ADF process means 171, sorter process means 172 and finisher process means 173 are connected to the CPU with the signals exchanged between each of these components.

Figure 17:
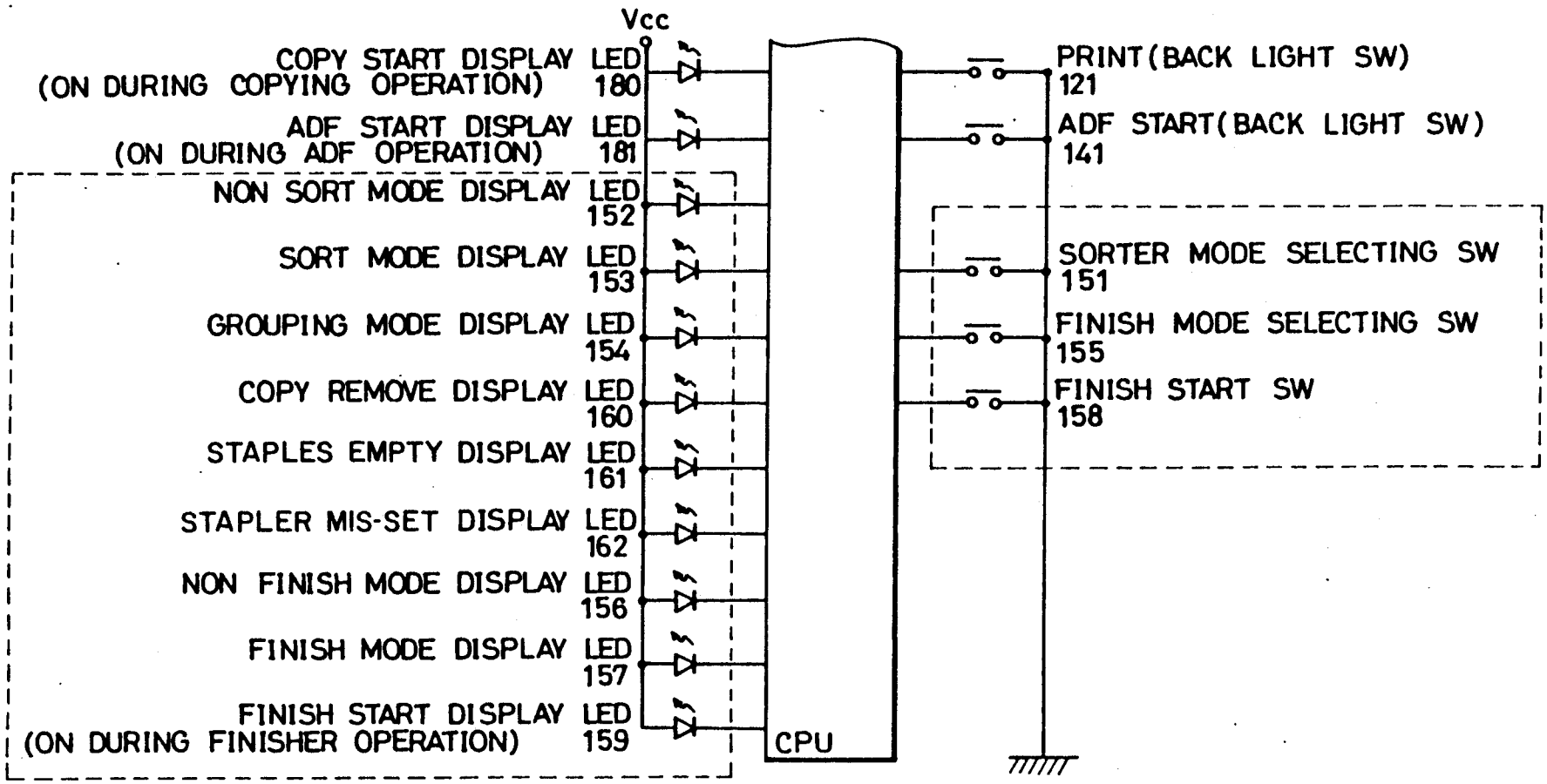

FIG. 17 shows a main portion of the control circuit. A print switch 121, an ADF start switch 141, display LEDs 180 and 181 contained in these switches, switches 151, 152 and 158 of the sorter panel 150 and displaying LEDs 152 and so on are connected to an input/output port of the microcomputer CPU.

Steps of Control

In the following, the steps of control based on the above described copying machine 1, the sorter 40 and the control circuit will be described with reference to the flow charts of FIGS. 18 to 30.

Figure 18:
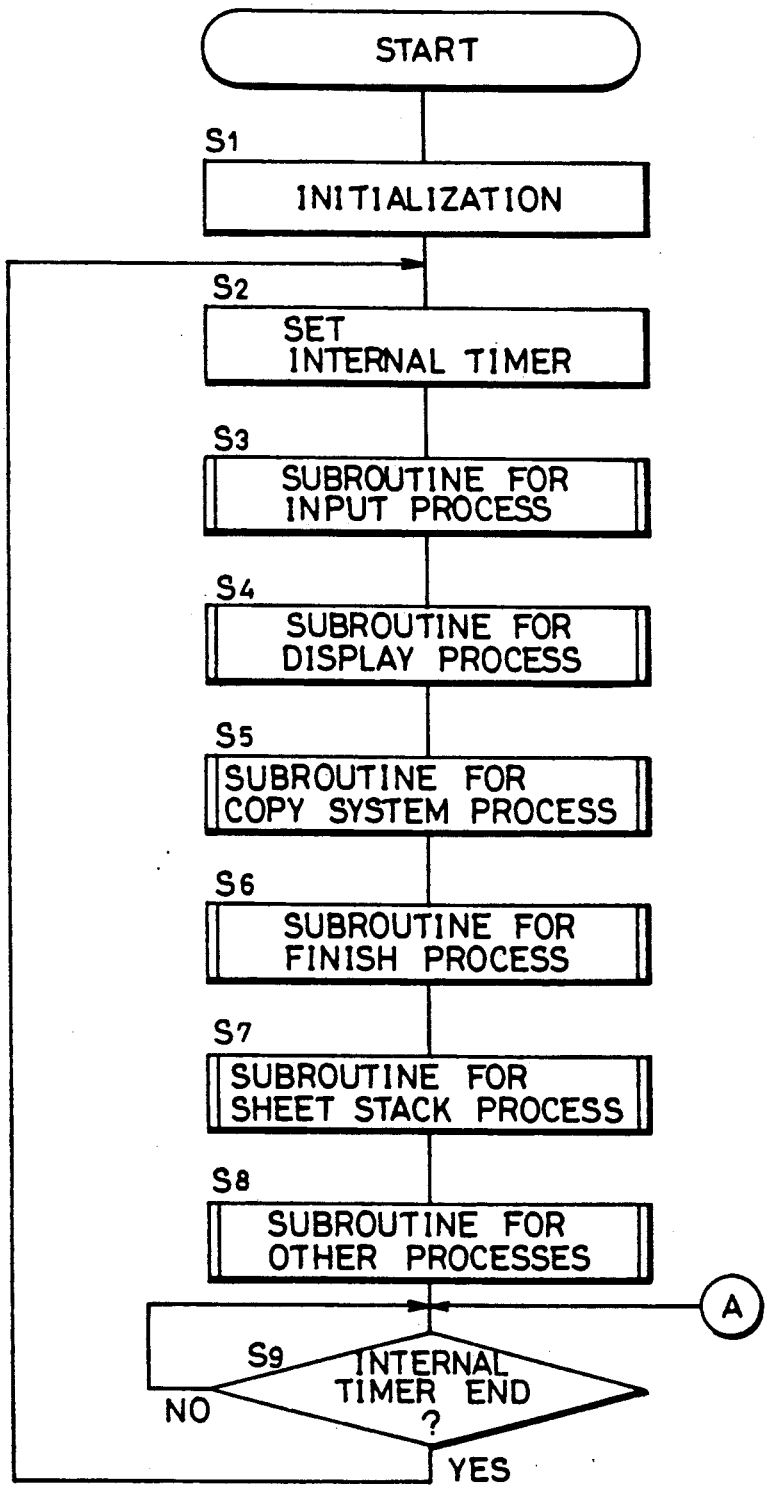

FIG. 18 shows a main routine of the said microcomputer CPU.

When the microcomputer CPU is reset and the program is started, initialization is carried out in the step S1 in which a random access memory is cleared, various registers are initialized and respective apparatuses are set at an initial mode. Thereafter, operation of an internal timer is started in the step S2. This internal timer is to define a time required for carrying out the main routine, whose value is set in the step of initialization S1.

Thereafter, respective subroutines, the details of which will be described later, are successively called in the steps S3 to S8, and when the processes of all subroutines are completed, and the operation of the said internal timer is finished in the step S9, the flow returns to the step S2. Various timers used in respective subroutines are counted in accordance with the time of 1 routine.

Figure 19A:
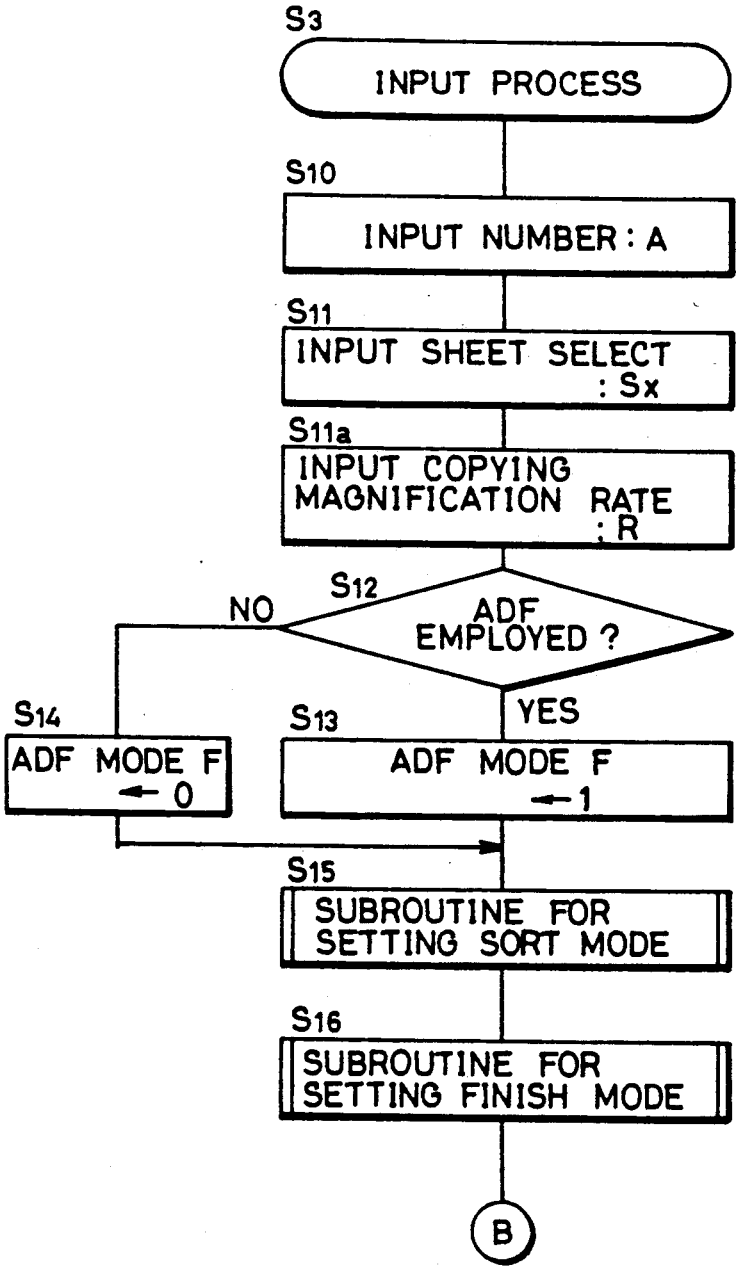

FIG. 19 shows a subroutine of input processing carried out in the step S3.

At first, a number A to be set is inputted by the ten key group 124 on the copying machine panel 120, a selected sheet size $S_X$ is inputted in the step S11, and a copying magnification rate R is inputted in the step S11*a*. Whether employment of the ADF 30 is selected or not is checked in the step S12. If the employment is selected, then a ADF mode flag is set at "1" in the step S13, otherwise the ADF mode flag is reset at "0" in the step S14.

Thereafter, a subroutine for setting the sort mode is executed in the step S15, the subroutine for setting the finish mode is executed in the step S16, and whether the sort mode flag is "1" or not is checked in the step S17. If the sort mode flag is "0", neither the sorting nor the stapling process is to be carried out, so that the flow proceeds to the step S22. If it is "1", then the number a of bins set in the sorter 40 is inputted in the step S18, and the set number A and the number a of bins are compared with each other in the step S19. If the set number A is no more than the number a of bins, the sort mode is available, so that whether the finish mode flag is "1" or not is checked in the step S20. If the finish mode flag is "0", then the flow proceeds to the step S22. If it is "1", then whether the sheet size $S_X$ inputted in the step S11 is A4 or B5 is checked in the step S21. The size of sheets which can be stapled in this embodiment is A4 or B5. If the answer is YES in this step, other input presses are carried out in the step S22.

Whether the print switch 121 is turned on or not is checked in the step S23. If it is on, then a copy flag is set at "1" in the step S24 to permit the copying operation. If it is not on, then whether the ADF start switch 141 is turned on or not is checked in the step S25. If it is on, the step S24 is carried out. Otherwise, the subroutine is finished.

Meanwhile, if it is determined that the set number A is larger than the bin number a in the step S19, then a warning flag F1 is set at "1" in the step S26 and the system operation is prohibited in the step S27. The warning flag F1 indicates that the number of distribution exceeds the number of bins. Thereafter, whether the print switch 121 is turned or not, and whether the ADF start switch 141 is turned on or not are checked in the steps S28 and S36 in the similar manner as in the steps S23 and S25. If it is YES in the step S28 or S36, namely, if the operator is going to carry out the copying operation in spite of the warning, then the non-sort mode flag is set at "1" in the step S29 to switch the operation to the non-sort mode, the warning flag F1 is reset at "0" in the step S30, the prohibition of the system operation is released in the step S30*a*, and the copy flag is set at "1" in the step S37.

When it is determined that the sheet size $S_X$ is neither A4 nor B5 in the step S21, then the stapling process is not available. Therefore, a warning flag F2 is set at "1" in the step S31, and the system operation is prohibited in the step S32. The warning flag F2 indicates that the selected sheet size is not acceptable. Thereafter, whether the print switch 121 is turned on or not, and whether the ADF start switch 141 is turned on or not are checked in the steps S33 and S38 in the similar manner as in the steps S23 and S25. If it is YES in the step S33 or S38, namely, if the operator is going to carry out the copying operation in spite of the warning, then the finish mode flag is reset at "0" in the step S34 to prohibit the stapling process, the warning flag F2 is reset at "0" in the step S35, the prohibition of the system operation is released in the step S35*a* and the copy flag is set at "1" in the step S39.

Figure 20:
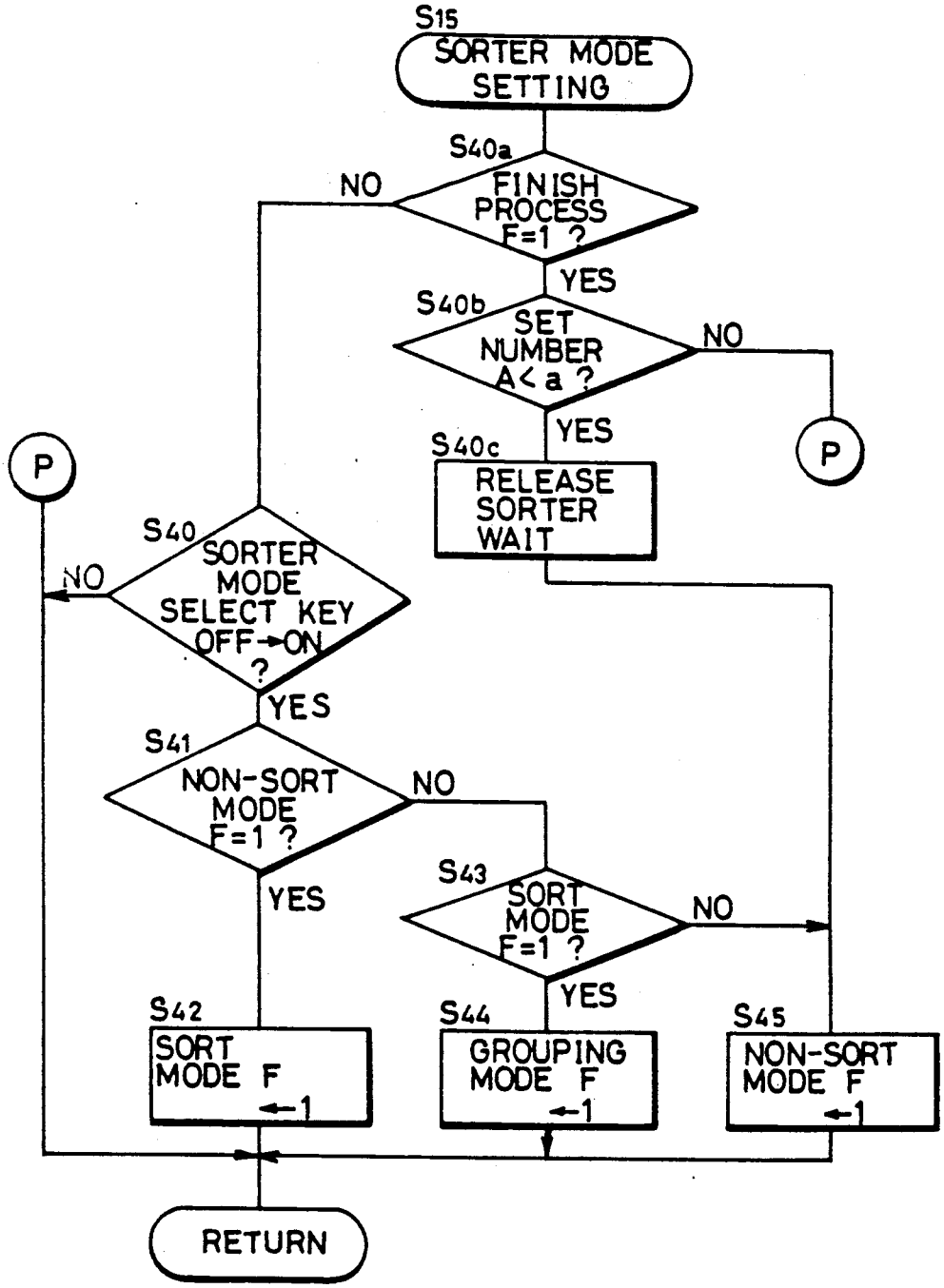

FIG. 20 shows a subroutine for setting the sort mode executed in the step S15.

In this subroutine, whether a finish process flag is "1" or not is checked in the step S40*a*. The finishing process means the flowing steps of operation. Namely, taking out the sheets distributed and contained in the respective bins 60 at the sorter portion 41 from the respective bins 60, conveying the sheets onto the staple tray 91 at the conveying portion 80, aligning the sheets, stapling the sheets by the stapler 100, and stacking the sheets in the stack tray 111. While the above described series of operation is being carried out, the finish processing flag is kept at "1". Therefore, the sort mode can be freely set in the step following the step S40 only when the finish processing flag is at "0".

Namely, whether the sorter mode selecting key 151 is switched from off to on is determined in the step S40, and if it is not switched, the flow directly returns to the main routine. When the key 151 is switched on, then whether the non-sort mode flag is "1" or not and whether the sort mode flag is "1" or not are checked in the steps S41 and S43. When the non-sort mode flag is set at "1", then the sort mode flag is set at "1" in the step S42. When the sort mode flag is set at "1", then the grouping mode flag is set at "1" in the step S44. When both of the non-sort mode flag and the sort mode flag are reset at "0", then the non-sort mode flag is set at "1" in the step S45.

Meanwhile, even when it is determined that the finish process flag is set at "1" in the step S40*a*, control is carried out to enable copying operation under a prescribed condition. More specifically, even when the operation is in the finish mode, the copying operation in parallel to the stapling operation is available provided that the uppermost bin 60 is available, and an operation mode for receiving the sheets at the said bin 60 is accepted.

More specifically, whether the set number A is smaller than the number a of bins or not is checked in the step S40*b* and if the set number is smaller than the bin number, it means that the uppermost bin 60 is not used for sorting in the finish mode (available), so that the sorter wait is cancelled in the step S40*c*, and the non-sort mode flag is set at "1" in the step S45. The sorter wait means the prohibition of the copying operation of the copying machine 1 to prevent feeding of sheets into the sorter 40 during the operation of the bins 60. In this case, however, the sorter wait is cancelled when the uppermost bin 60 is available, so as to allow copying operation in the non-sort mode.

If it is determined that the set number A is equal to the number a of bins in the step S40*b*, it means that the uppermost bin 60 is used for sorting. Therefore, the following processes are not carried out and the subroutine is terminated.

Figure 21:
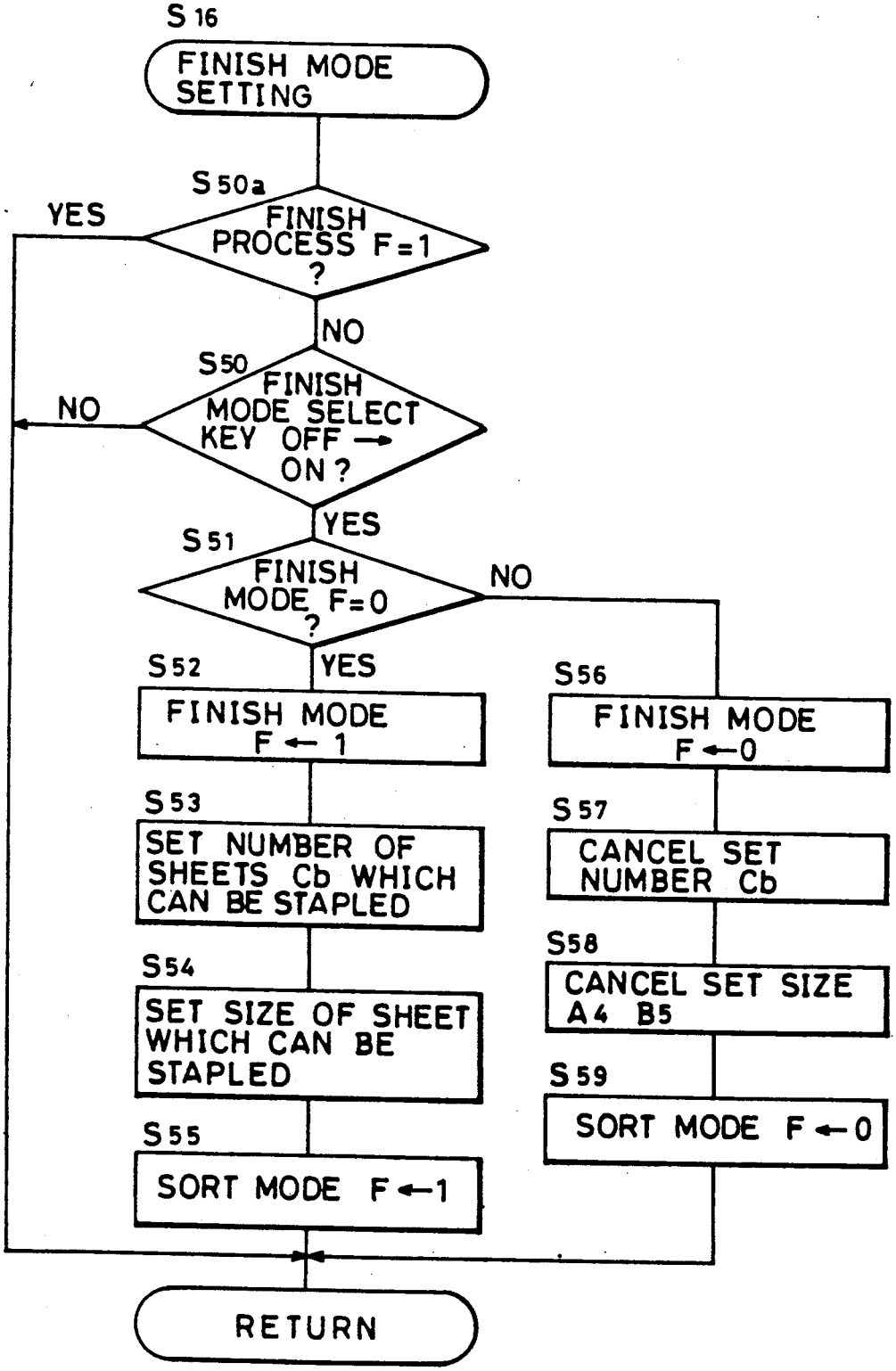

FIG. 21 shows a subroutine of setting a finish mode executed in the step S16.

First, whether the finish process flag is "1" or not is checked in the step S50*a*. If it is set at "1", the flow directly returns to the main flow. If it is reset at "0", then the setting of the finish mode is allowed in the steps following the step S50.

More specifically, whether the finish mode selecting key 155 is switched from off to on or not is determined in the step S50. It it is not switched, then the flow directly returns to the main routine. When the key 155 is turned on, then whether the finish mode flag is "0" or not is checked in the step S51. When it is reset at "0", the finish mode flag is set at "1" in the step S52, and the number of sheets Cb which can be stapled is set in the step S53. Thereafter, the size of sheets capable of being stapled is set at A4 or B5 in the step S54, and the sort mode flag is set at "1" in the step S55 to permit the processes in the sort mode.

Meanwhile, when it is determined that the finish mode flag is set at "1" in the step S51, then the finish mode flag is reset at "0" in the step S56, and the setting of the number of sheets Cb which can be stapled is cancelled in the step S57. Thereafter, the setting of the size of the sheets capable of being stapled is cancelled in the step S58 and the sort mode flag is reset at "0" in the step S59 to prohibit the processes in the sort mode.

Figure 22A:
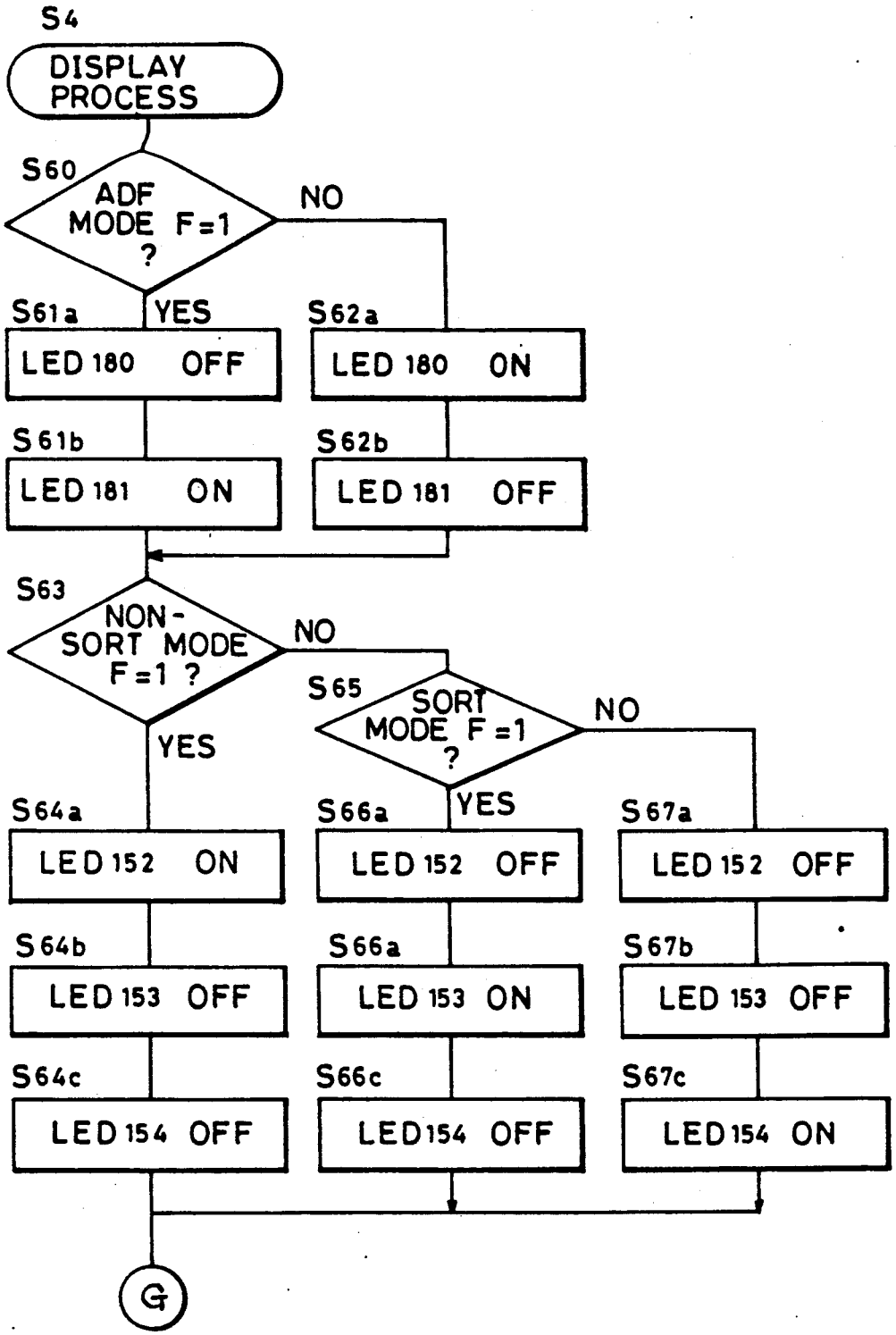
Figure 22A:
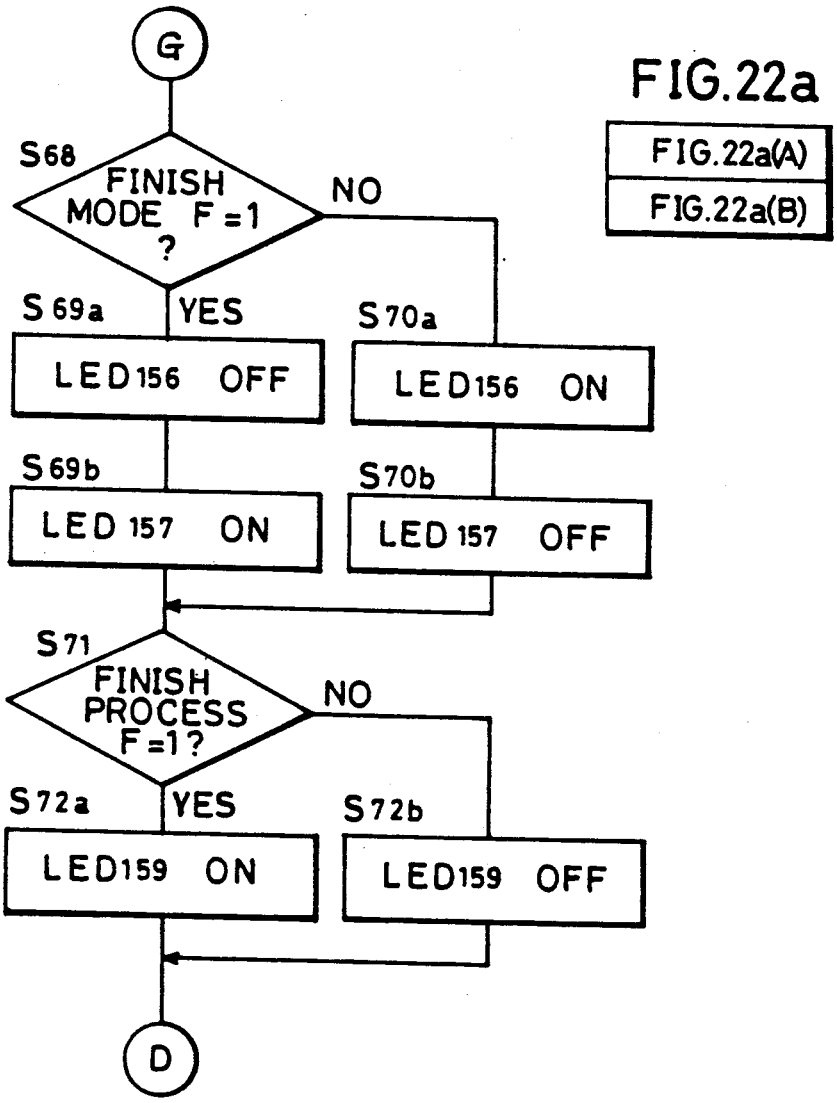
Figure 22B:
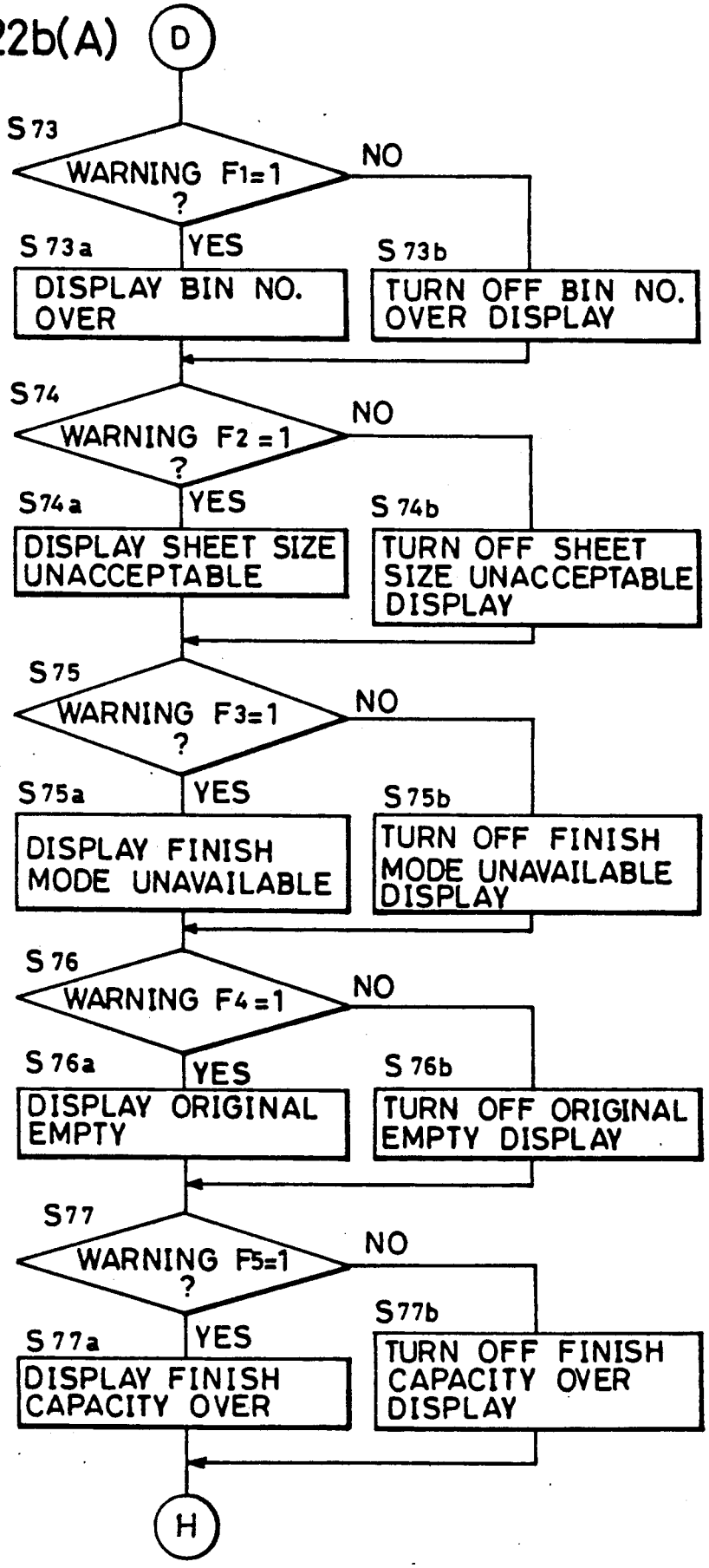
Figure 22B:
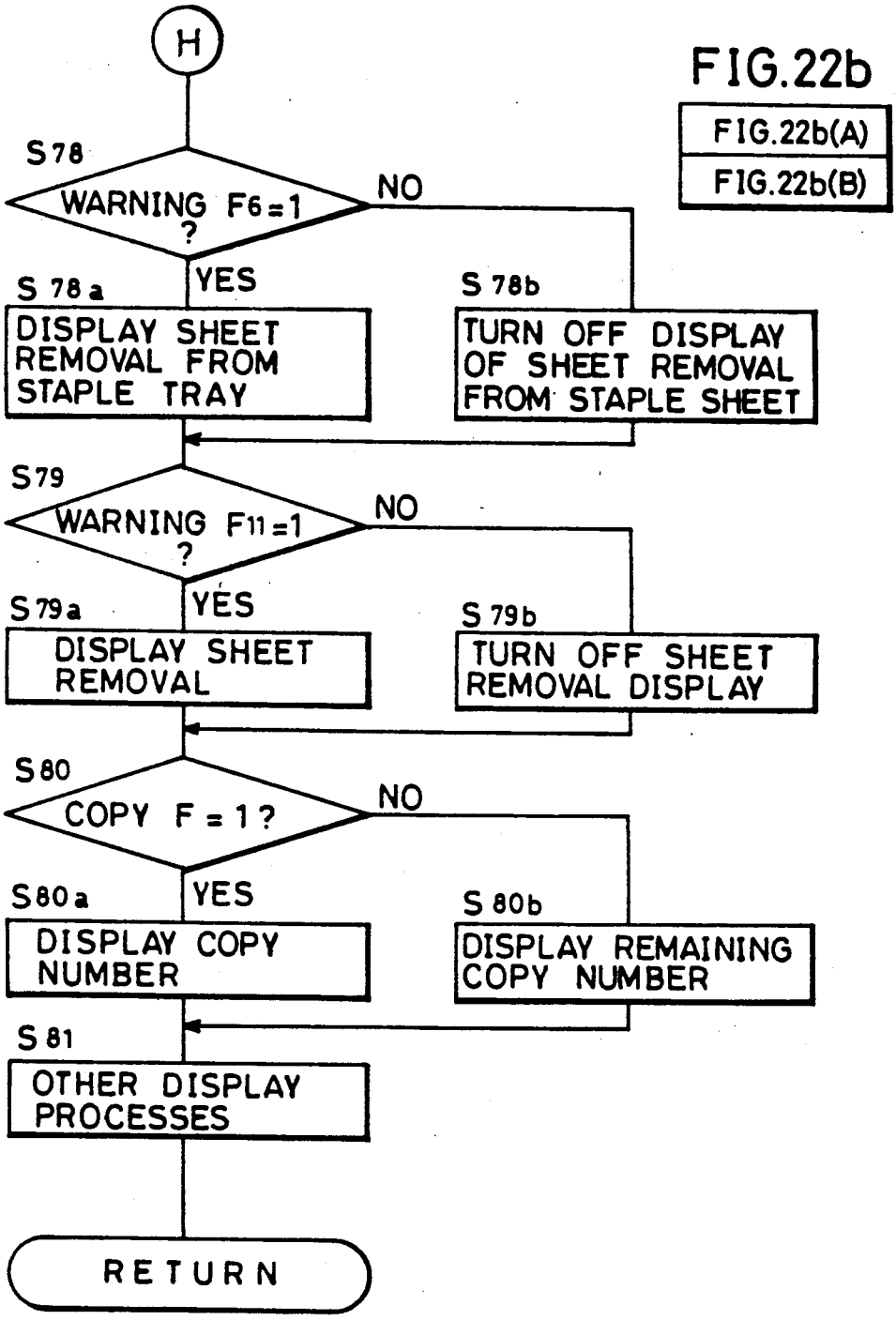

FIGS. 22*a* and 22*b* show a subroutine of display processes carried out in the step S4 of the main routine.

At first, whether the ADF mode flag is "1" or not is checked in the step S60. When it is "1", then a copy start display LED 180 in the mode in which the ADF 30 is not used is turned off in the step S61*a*, and the ADF start displaying LED 181 is turned on in the step S61*b*. When the ADF mode flag is "0", then the LED 180 is turned on in the step S62*a* while the LED 181 is turned off in the step S62*b*.

Thereafter, whether the non-sort mode flag is "1" or not and whether the sort mode flag is "1" or not are respectively checked in the steps S63 and S65. When the non-sort mode flag is "1", then a non-sort mode displaying LED 152 is turned on in the step S64*a*, and the LEDs 153 and 154 are turned off in the steps S64*b* and S64*c*. When the sort mode flag is "1", then the LED 152 is turned off in the step S66*a*, the sort mode displaying LED 153 is turned on in the step S66*b*, and the LED 154 is turned off in the step S66*c*. When both of the non-sort mode flag and the sort mode flag are "0", then the LEDs 152 and 153 are turned off in the steps S67*a* and S67*b*, and a grouping mode displaying LED 154 is turned on in the step S67*c*.

Thereafter, whether the finish mode flag is "1" or not is determined in the step S68. When it is "1", then a non-finish mode displaying LED 156 is turned off in the step S69*a* and a finish mode displaying LED 157 is turned on in the step S69*b*. When the finish mode flag is "0", then the LED 156 is turned on in the step S70*a* and the LED 157 is turned off in the step S70*b*. Thereafter, whether the finish process flag is "1" or not is checked in the step S71. When the finish process flag is "1", then a finish start displaying LED 159 is turned on in the step S72*a*. If it is "0", then the LED 159 is turned off in the step S72*b*.

In the step S73, whether the warning flag F1 is "1" or not is checked. If it is "1", the excess of the bin number is displayed on the display portion 125 in the step S73*a*. If it is "0", this display is turned off in the step S73*b*. Whether the warning flag F2 is "1" or not is checked in the step S74. If it is "1", then it is displayed in the displaying portion 125 that the sheet size is not acceptable in the step S74*a*. If it is "0", then this display is turned off in the step S74*b*. Whether the warning flag F3 is "1" or not is checked in the step S75. If it is "1", then it is displayed in the display portion 125 that the finish mode is unavailable in the step S75*a*. If it is "0", then this display is turned off in the step S75*b*. Whether a warning flag F4 is "1" or not is checked in the step S76. When it is "1", then it is displayed in the displaying portion 125 that there is no original in the step S76*a*. If it is "0", then this display is turned off in the step S76*b*. Whether a warning flag F5 is "1" or not is checked in the step S77. If it is "1", then it is determined in the displaying portion 125 that the capacity of finishing is exceed. If it is "0", then this display is turned off in the step S77*b*. Whether a warning flag F6 is "1" or not is checked in the step S78. If it is "1", then the LED 159 is flickered in the step S78*a* to indicate that the sheets must be removed from the staple tray 91. If it is "0", this display is turned off in the step S78*b*. In the step S79, whether a warning flag F11 is "1" or not is checked. If it is "1", an LED 160 is turned on in the step S79*a* to indicate that the sheets must be removed from the bins 60. If it is "0", then this display is turned off in the step S79*b*.

Thereafter, whether the copy flag is "1" or not is checked in the step S80. When it is "1", then the number of copies is displayed in the display portion 125 in the step S80*a* and if it is "0", the remaining number of copies is displayed in the display portion 125 in the step S80*b*, respectively. Thereafter, other displaying processes are carried out in the step S81*a*, and the subroutine is finished.

Figure 23A:
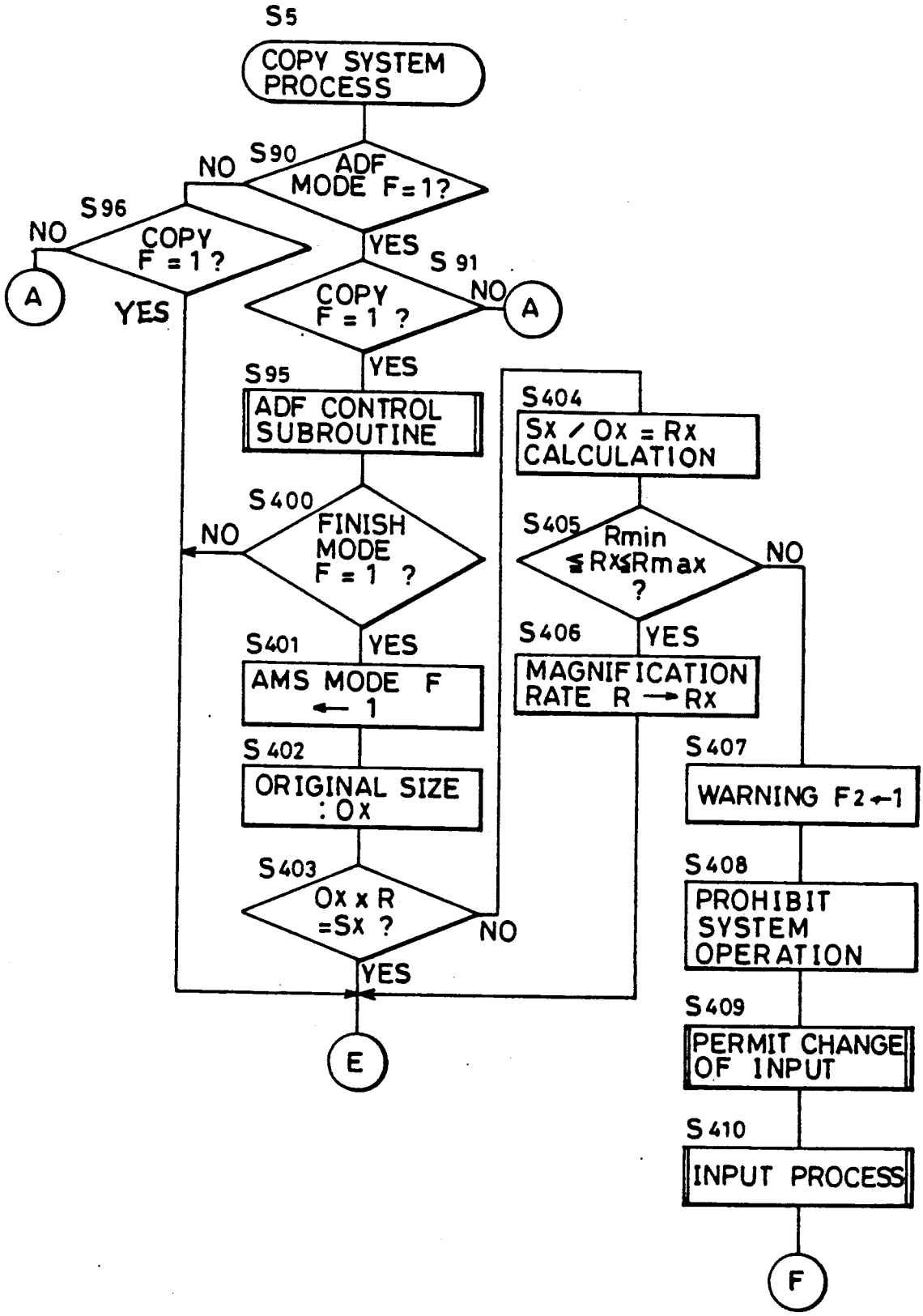
Figure 23B:
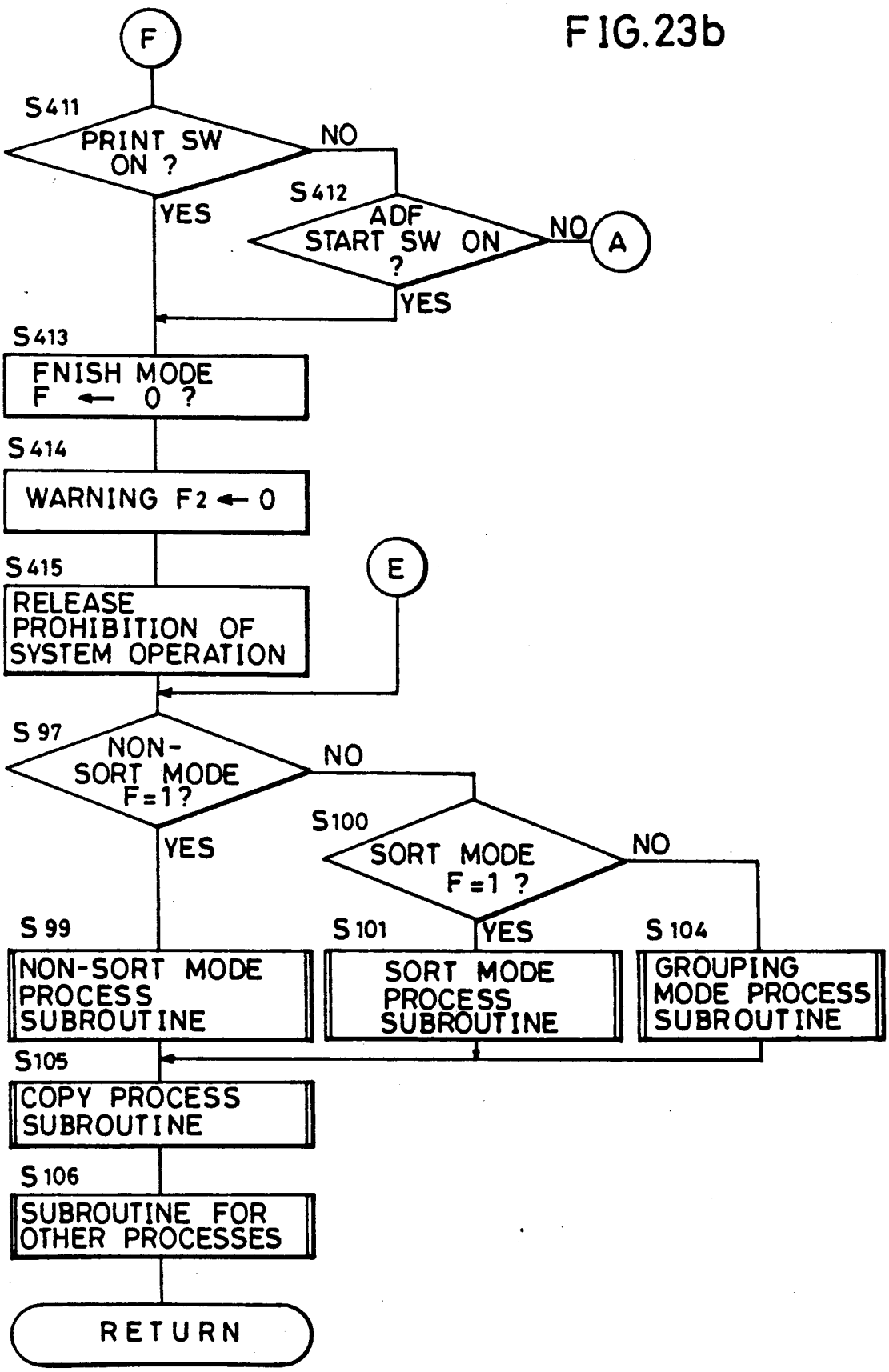

FIGS. 23*a* and 23*b* show a subroutine of copy system process executed in the step S5 in the main routine.

First, whether the ADF mode flag is "1" or not is checked in the step S90. When it is "1", then whether the copy flag is "1" or not is checked in the step S91. If it is "1", it means that the copying operation is available, so that the subroutine of the ADF control is carried out in the step S95 and the flow proceeds to the step S400. Meanwhile, when it is determined that the ADF mode flag is "0" in the said step S90, then whether the copy flag is "1" or not is checked in the step S96. If it is "1", then the flow proceeds to the step S97. When it is determined that the copy flag is "0" in both of the steps S91 and then the flow returns to the main routine.

When the subroutine of the ADF control, the details of which will be described later, is completed in the step S95, then whether the finish mode flag is "1" or not is checked in the step S400. If it is "0", then the flow proceeds to the step S97. Meanwhile, if it is "1", the the AMS mode flag is set at "1" in the step S401 and the original size Ox is called from the RAM in the step S402. The size of the original Ox is the size of the original detected and stored in the RAM in the step S122 in the ADF control, which is the size of the original to be copied.

Thereafter, whether a multiplication of the original size Ox by the copying magnification rate R set at that time is equal to the copy sheet size Sx or not is checked in the step S403. If it is equal to the sheet size, the flow proceeds to the step S97. Otherwise, the sheet size Sx is divided by the original size Ox in the step S404 to find the most suitable copying magnification rate Rx for the sheet of the selected size. Thereafter whether the most suitable copying magnification rate Rx is in the range of an available copying magnification rate Rmin, Rmax for expansion or reduction in the copying machine 1 or not is checked in the step S405. If it is in the available range, then the copying magnification rate is changed from R to Rx in the step S406, and the flow proceeds to the step S97. If it is out of the available range, then the warning flag F2 is set at "1" in the step S407 and the system operation is prohibited in the step S408. The flow is kept in a waiting state until a decision of the operator to carry out the copying operation or not is given. Although the steps of control in this case are not shown, when the finish start switch 158 is turned on, the finish processing is started, and the sheets contained in the bins of the sorter at that time are stapled. Meanwhile, if the operator is going to continue the series of copying operations, then the change of inputs of the copying conditions are permitted in the step S409, the input process is carried out in the step S410, and the flow proceeds to the step S411.

Thereafter, whether the print switch 121 or the ADF start switch 141 is turned on or not is determined in the steps S411 and S412. When neither the switch 121 nor the switch 141 is turned on, then the flow returns to the main routine. When either one of the switches is turned on, then the finish mode flag is reset at "0" in the step S413. Thereafter, the warning flag F2 is reset at "0" in the step S414, the prohibition of the system operation is released in the step S415 and the flow proceeds to the step S97.

Thereafter, whether the non-sort mode flag and the sort mode flag are respectively "1" or not are checked in the steps S97 and S100. When the non-sort mode flag is "1", then the subroutine for the non-sort mode processing is carried out in the step S99. If the sort mode flag is "1", then the subroutine for the sort mode processing is carried out in the step S101. When the non-sort mode flag and the sort mode flag are both "0", then a subroutine for the grouping mode processing is carried out in the step S104. Thereafter, the subroutine of the copying operation is carried out in the step S105, and the subroutine for other processes is carried out in the step S106.

The subroutines executed in the steps S99 and S104 are the same as the conventional processes, so that the detailed description thereof will be omitted.

Figure 24A:
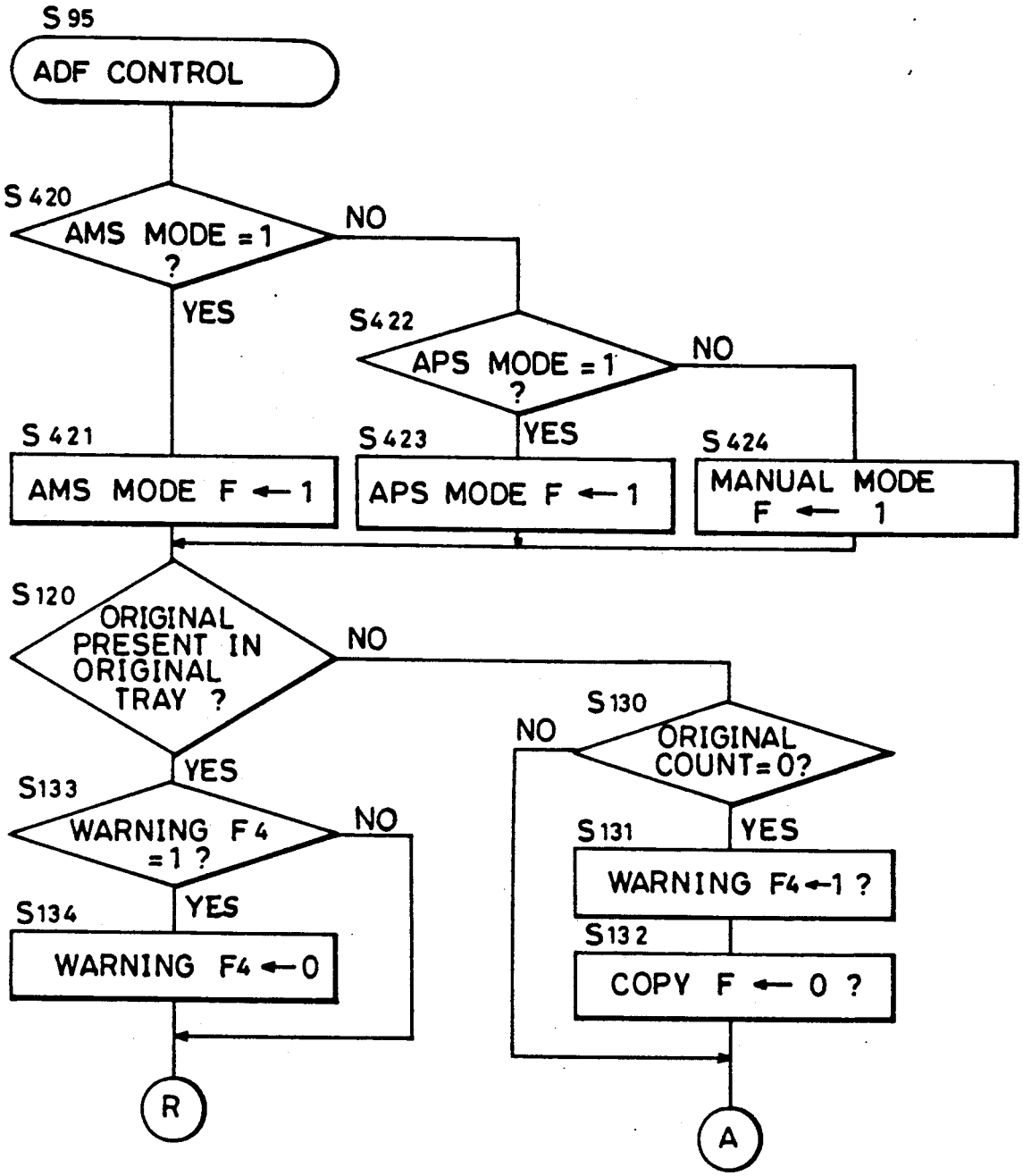
Figures 24, 24B:
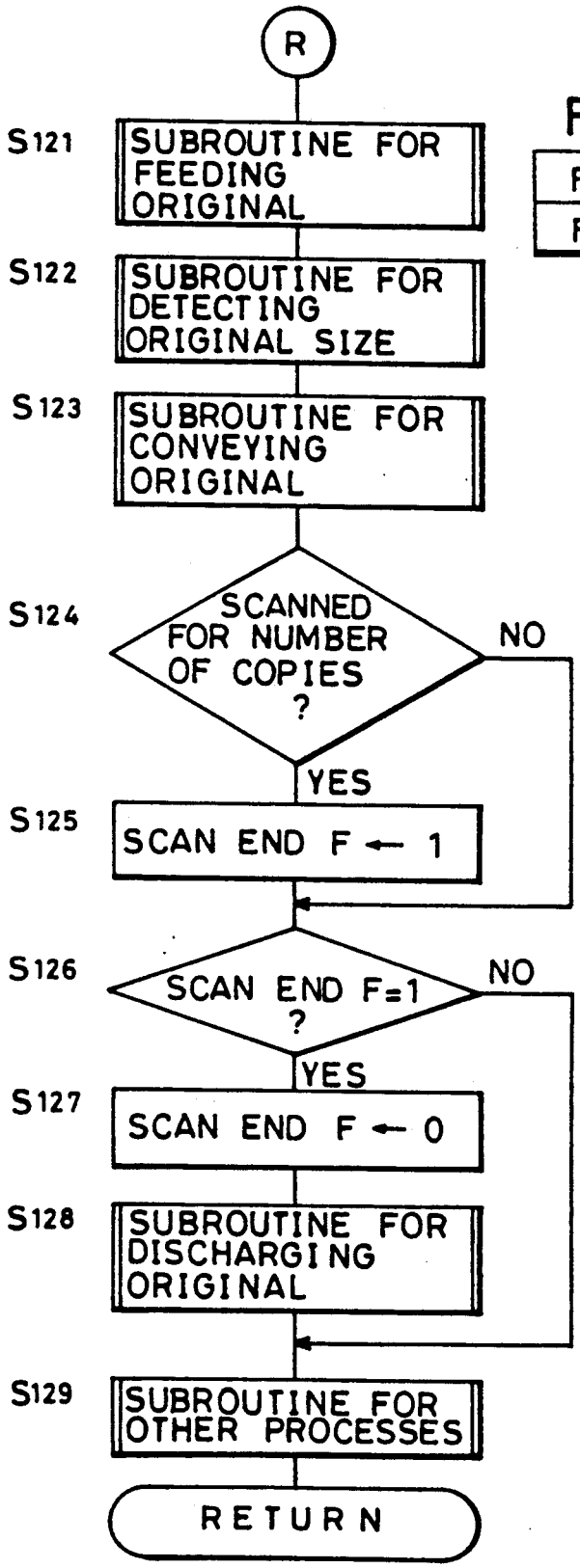

FIG. 24 shows a subroutine of the ADF control executed in the step S95.

First, in the step S420, whether the AMS mode is selected or not is checked and in the step S422, whether the APS mode is selected or not is checked. The flag of the selected mode is set at "1" in the steps S421 and S423. When neither of them is selected, then a manual mode flag is set at "1" in the step S424.

Thereafter, whether there is an original in the original tray 31 or not is checked based on the on/off state of the sensor in the step S120. When there is an original, then whether the warning flag F4 is "1" or not is checked in the step S133. The warning flag F4 is set at "1" in the step S131 when there is no original in the tray 31, as will be described later. When the flag has been "1", then it is reset at "0" in the step S134. The subroutine for feeding paper is carried out in the step S121, the subroutine for detecting the original size is carried out in the step S122, and the subroutine for feeding the original is carried out in the step S123. When there is no original, then whether the original count is "0" or not is checked in the step S130. If it is "0", then the warning flag F4 is set at "1" in the step S131 to prepare an original empty display, the copy flag is reset at "0" in the step S132, and the flow returns to the main routine.

Meanwhile, whether the optical system 4 has finished scanning for the required number of copies or not is checked in the step S124. If the scanning has been finished, then the scan end flag is set at "1". After it is checked that the scan end flag is "1" in the step S126, then the scan end flag is reset at "0" in the step S127, the subroutine for discharging the original is carried out in the step S128, and the subroutine for other processes is carried out in the step S129.

The ADF control subroutine is the same as the conventional process, so that the detailed description of the steps S121, S122, S123 and S128 is omitted.

Figure 25A:
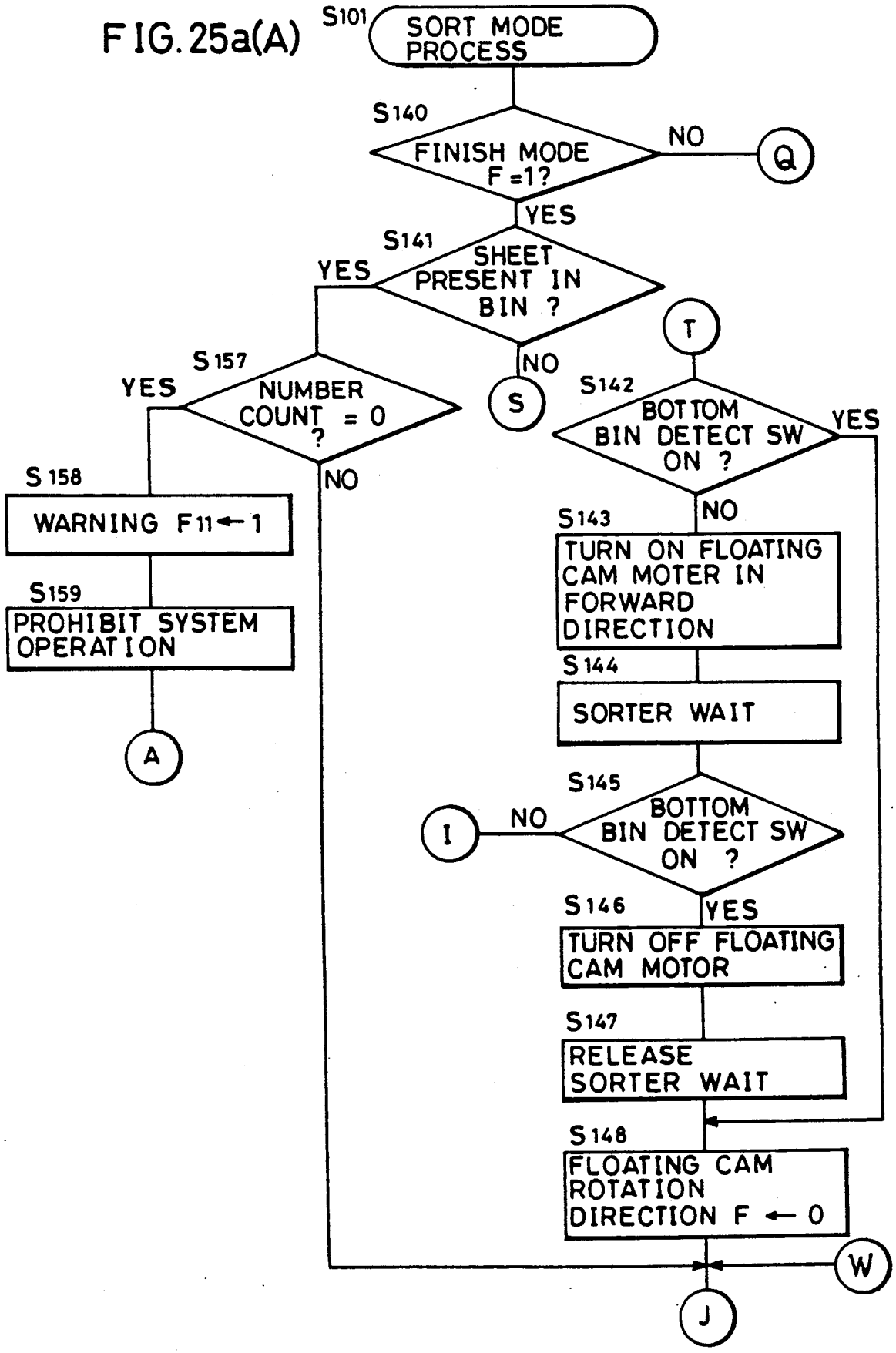
Figure 25A:
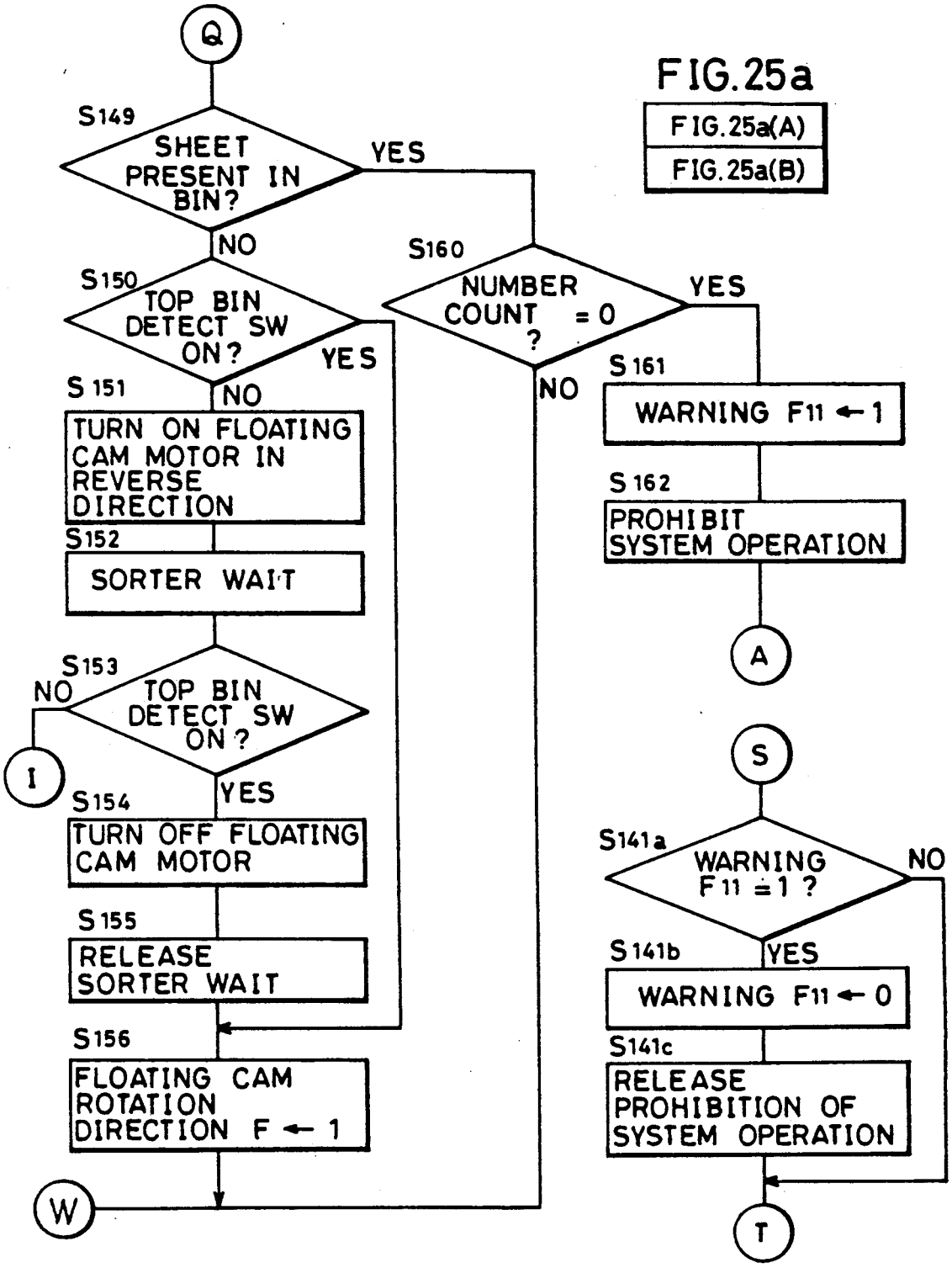
Figure 25B:
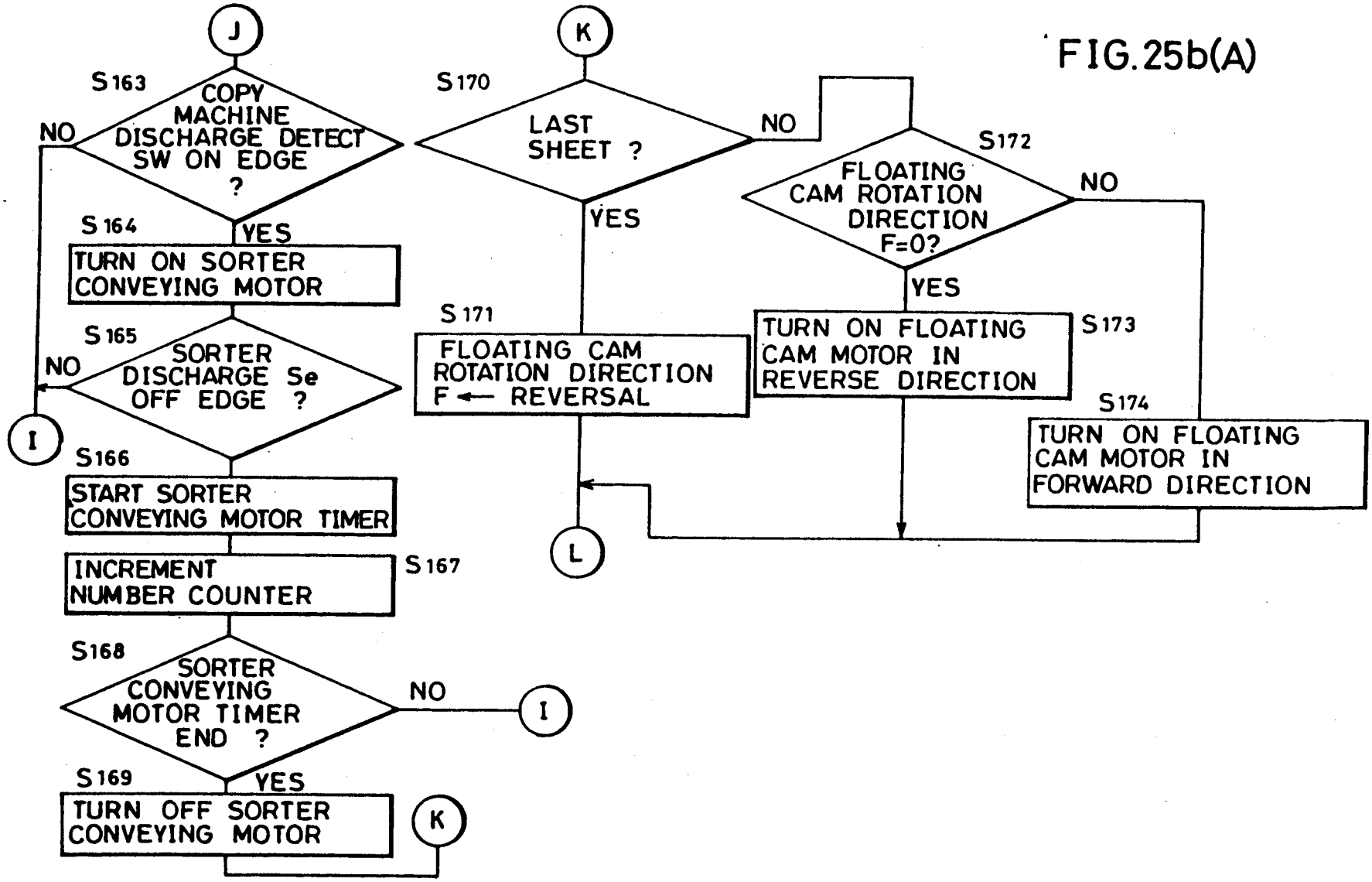
Figure 25B:
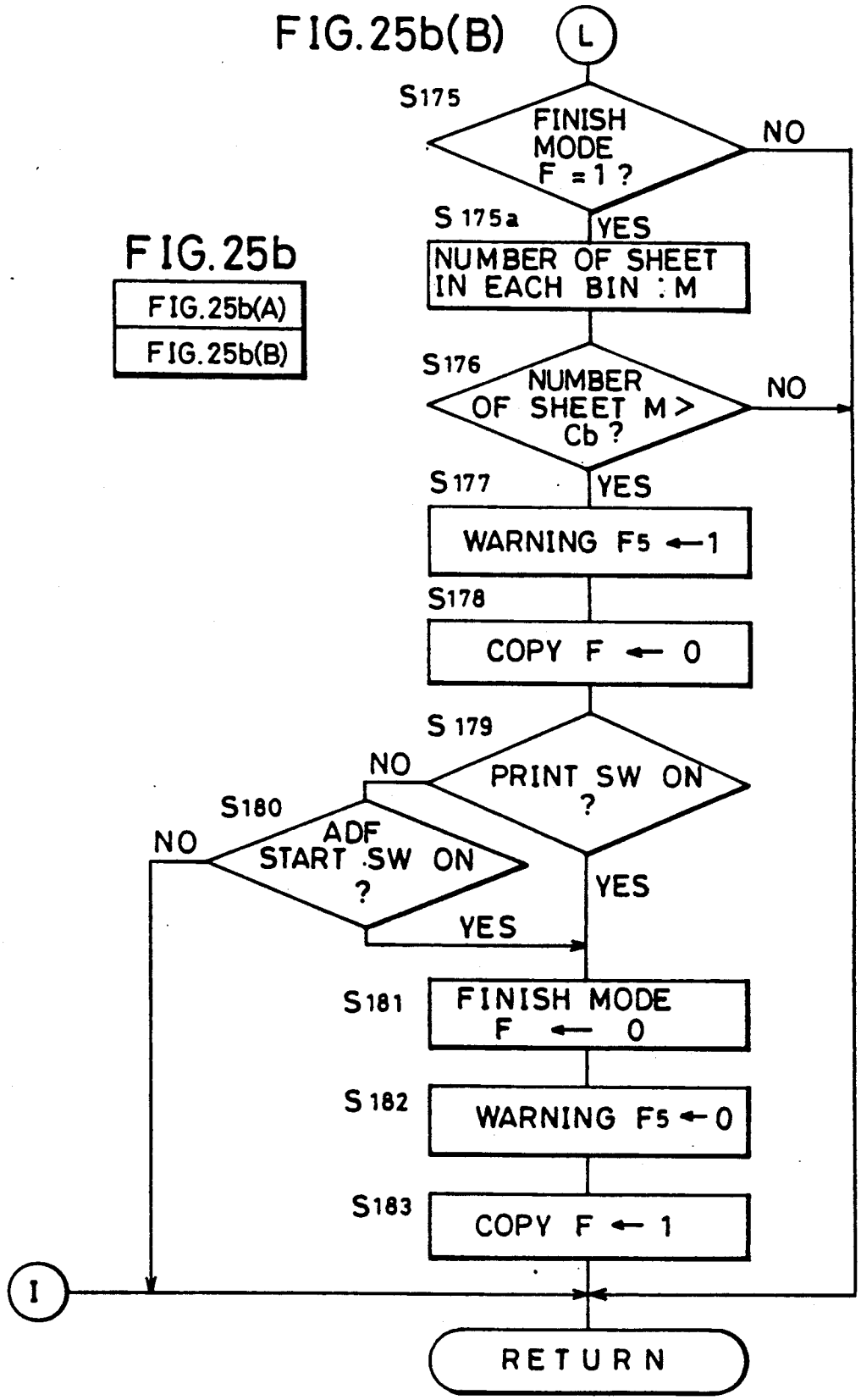

FIGS. 25*a* and 25*b* show a subroutine of the sort mode processing carried out in the step S101. In this subroutine, the operation of the sorter bins 60 is changed based on the selection/non-selection of the finish mode. The reason for this is that the order of taking out the sheets from the bins 60 differs dependent on the selection/non-selection of the finish mode and, accordingly, the order of distribution to the bins 60 is different. When the finish mode is selected, then the sheets are distributed starting from the lower bins 60 in order to feed the sheets to the staple portion 90. When the finish mode is not selected, then the sheets are distributed starting from the upper bins 60 in order to facilitate taking out of the sheets by the operator.

More specifically, whether the finish mode flag is "1" or not is checked in the step S140. If it is "1", then whether there is at least one sheet in the bin or not is checked in the step S141 based on the on/off of the sensor Se5. If there is no sheet, then, whether the warning flag F11 is "1" or not is checked in the step S141*a*. The warning flag F11 is set at "1" in the steps S158 and S161 when the sheet is in the bin 60, as will be described later. When the warning flag has been "1", then it is reset at "0" in the step S141*b*, and the prohibition of the system operation is released in the step S141*c*. Whether the bottom bin detecting switch SW1 is on or not, that is, whether the bin 60 is positioned at the bottom bin position $X_1$ which is the home position in the finishing mode to permit the distribution of the sheets in the finishing mode or not is checked in the step S142. If it is YES in the step S142, then the flow directly proceeds to the step S148 and the operation of the bins to enable the sorting operation is carried out, namely, the rotation direction flag is reset at "0" in order to rotate the floating cam motor (not shown) in the reverse direction. If it is NO in the step S142, then the following steps S143 to S147 are carried out to move the bin 60 to the bottom bin position $X_1$. Namely, the motor of the floating cam 50 is rotated in the forward direction in the step S143, and the sorter wait is provided in the step S144. The sorter wait means prohibition of the copying operation in order to prevent feeding of the sheets to the sorter portion 41 during the movement of the bin 60. After it is checked that the bottom bin detecting switch SW1 is turned on in the step S145, the motor of the floating cam is turned off in the step S146, the sorter wait is cancelled in the step S147, the rotation direction flag of the floating cam is reset at "0" in the step S148, and the direction of rotation of the floating cam 50 is reversed.

Meanwhile, when the finish mode is not selected, then the presence/absence of the sheet in the bin 60 is checked based on the on/off state of the sensor Se5 in the step S149. If there is no sheet, then the top bin detecting switch SW2 is on or not, namely, whether the bin 60 is positioned at the top bin position $X_2$ which is the home position in the non-finish mode to enable distribution of the sheets in the non-finish mode or not is checked in the step S150. Therefore, if it is YES in the step S149, then the flow directly proceeds to the step S156, where the rotation direction flag of the floating cam is set at "1" to permit the rotation of the floating cam 50 in the forward direction. If it is NO in the step S149, then the next steps S151 to S155 are carried out to move the bin 60 to the top bin position $X_2$. Namely, the motor of the floating cam 50 is rotated in the reverse direction in the step S151, the sorter wait is provided in the step S152, it is checked that the top bin detecting switch SW2 is turned on in the step S153, and the motor of the floating cam 50 is turned off in the step S154. Thereafter, the sorter wait is cancelled in the step S155 and the rotation direction flag of the floating cam is set at "1" in the step S156 so that the floating cam 50 is rotated in the forward direction.

When it is determined that the bins 60 contain sheets in the steps S141 and S149, then whether the count of copy number is "0" or not is checked in the steps S147 and S160. If it is "0", then the warning flag F11 is set at "1" in the step S158 to prepare for the turning on of the LED 160 displaying the removal of the copy. The system operation is prohibited in the steps S159 and S162, and the flow returns to the main flow.

Thereafter, whether there is an on-edge of the discharging switch SW3 of the copying machine 1 or not is checked in the step S163. More specifically, as soon as the front end of the sheet reaches the discharging switch SW3, the sorter conveying motor is turned o in the step S164, and whether there is an off edge or not of the sorter discharging sensor Se1 is checked in the step S165. Namely, when the rear end of the sheet passes through the discharging sensor Se1, it is regarded that the sheet is fully fed into the bin 60 to be contained therein. And if there is an off edge, then the operation of a timer for the sorter conveying motor is started in the step S166. Thereafter, the count of the number is incremented in the step S167, and after the operation of the timer for the sorter conveying motor is finished in the step S168, the sorter conveying motor is turned off in the step S169. Thereafter, whether the conveyed sheet is the last sheet or not is checked in the step S170. If it is the last one, then the flag of the floating cam rotation direction is reversed in the step S171. Namely, if the flag for the floating cam rotation direction has been "0", it is changed to "1" while if it has been "1", it is reset at "0". If it is determined that the conveyed sheet is not the last one, the sorting operation is to be continued. Therefore, the flag of the floating rotation direction is checked in the step S172. If it is "0", then the floating cam motor is reversely turned on in the step S173. If it is "1", it is forwardly turned on in the step S174. Consequently, the sheets are distributed in a reciprocated manner from the lower bin 60 to the upper bin and from the upper bin to the lower bin 60.

Thereafter, whether the finish mode flag is "1" or not is checked in the step S175. If it is "1", then the number of sheets in each bin is calculated in the step S175*a*. The calculated number of sheets M of each bin is compared with the number of sheets Cb which can be stapled (see step S53) in the step S176. If the number of sheets M in each bin exceeds the number of sheets Cb which can be stapled, then a warning flag F5 is set at "1" in the step S177 to prevent defective stapling to prepare the display of the finisher capacity over. Thereafter, the copy flag is reset at "0" in the step S178, whether the print switch is turned on or not is checked in the step S179, and whether the ADF start switch 141 is turned on or not is checked in the step S180. If either is on, namely, if it is determined that the operator is going to carry out the copying operation in spite of the warning, then the finish mode flag is reset at "0" in the step S181, the warning flag F5 is reset at "0" in the step S182, and the copy flag is set at "1" in the step S183 to enable operation in the sort mode, and the subroutine is finished.

If the copying operation is to be finished and the finishing process is to be carried out when the warning of the finisher capacity over is given in the steps S176 and S177, then the finish start switch 158 may be turned on (see steps S206 and S207).

Figure 25C:
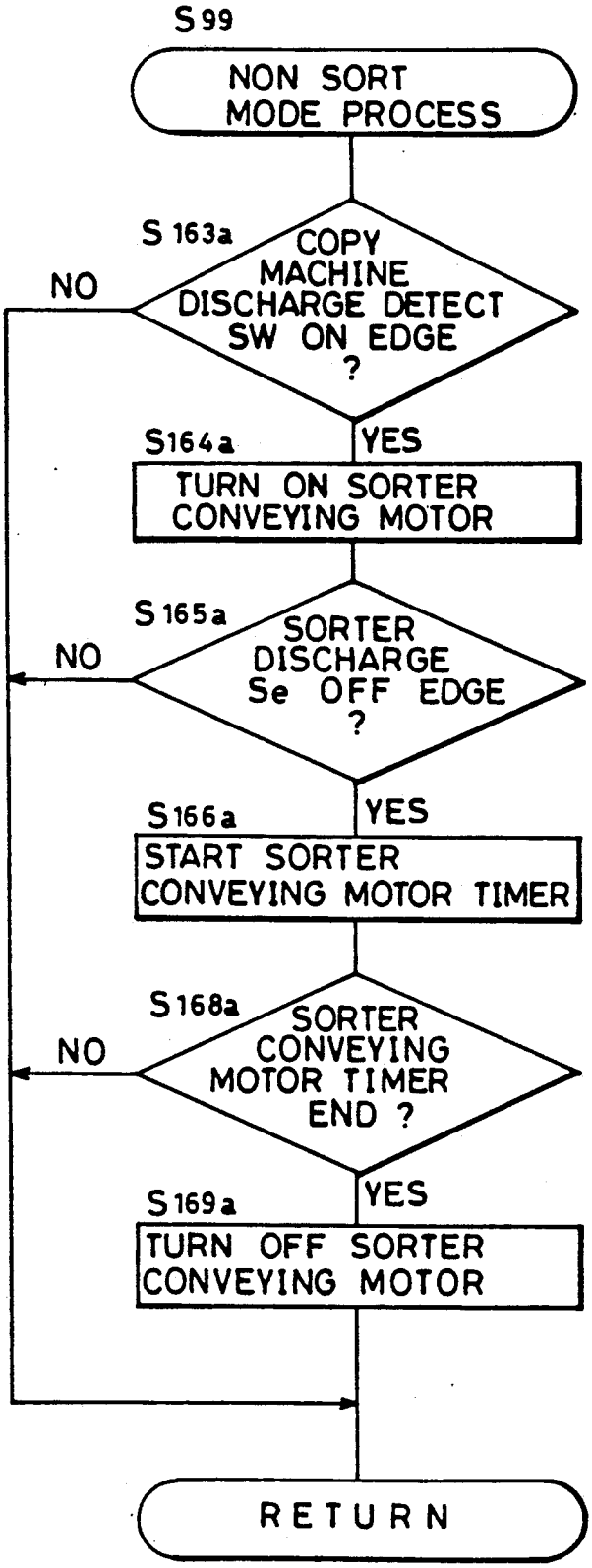

FIG. 25*c* shows a subroutine of the non-sort mode process executed in the step S99.

In this process, the sheets are contained in the uppermost bin 60 with the floating cam 50 positioned at the top bin position $X_2$.

Therefore, when an on edge of the discharging switch SW3 of the copying machine 1 is detected in the step S163*a*, then a sorter conveying motor is turned on in the step S164*a*. By doing so, the sheets are fed into the uppermost bin 60. Thereafter, when an off edge of the sorter discharging sensor Se1 is detected in the step S165*a*, then the operation of the timer for the sorter conveying motor is started in the step S166*a*. When the operation of the timer is finished in the step S168*a*, then the sorter conveying motor is turned off in the step S169*a*. Namely, every time a sheet is discharged from the copying machine 1, the above described operation is carried out, and the sheet is contained in the uppermost bin 60. This operation is normally carried out in the non-sort mode only. However, if a series of copying operation is finished, the above described operation can be carried out in parallel with the stapling process, which will be described later, even when the finish mode is being carried out.

Figure 26:
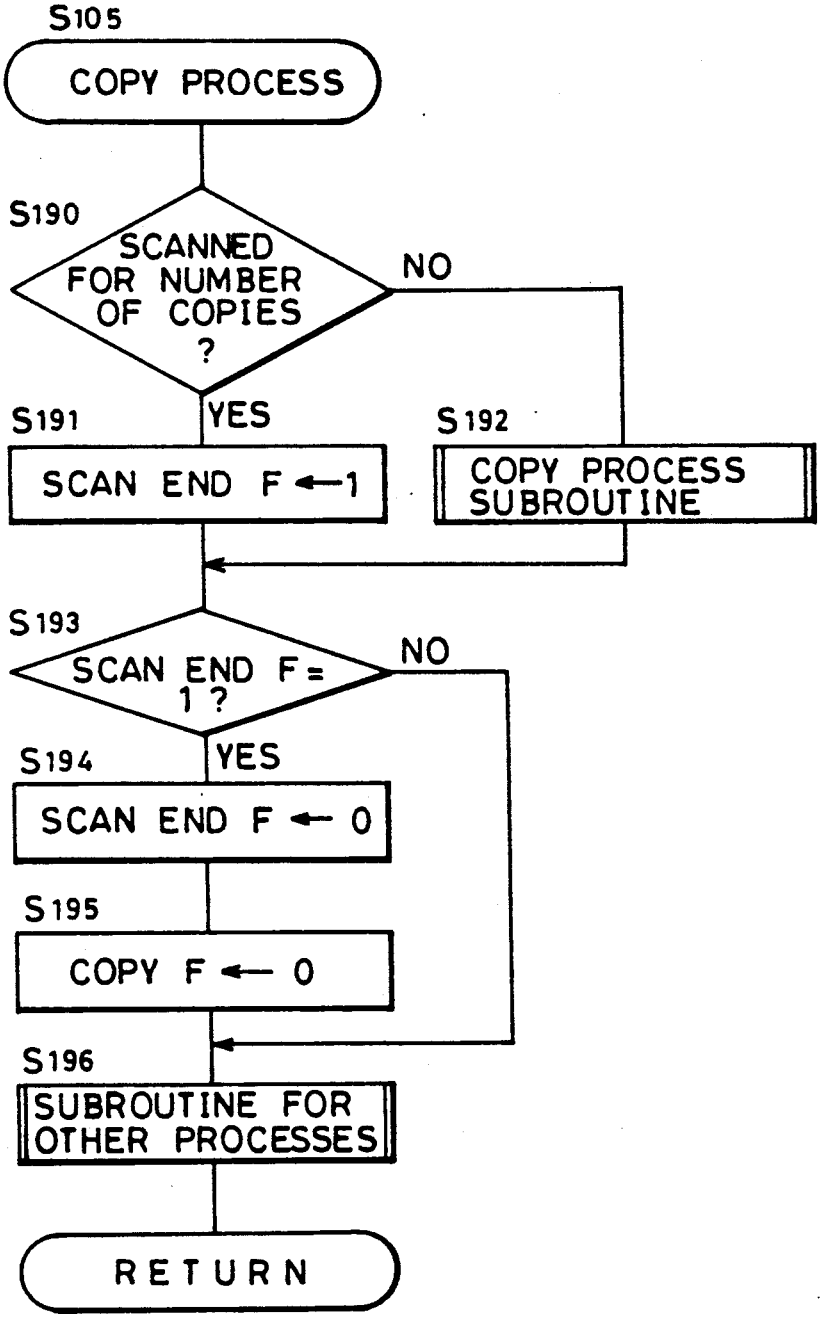

FIG. 26 shows a subroutine of the copying operation carried out in the step S105.

First, in the step S190, whether the scanning for the desired number of copies by the optical system 4 has finished or not is checked. If it is YES, then the scan end flag is set at "1" in the step S191. If it is NO, then the subroutine for the copy process operation is carried out in the step S192. This subroutine is to carry out the normal copying process by the copying machine 1, so that the detailed description thereof will be omitted.

After it is determined that the scan end flag is "1" the step S193, the scan end flag is reset at "0" in the step S194, the copy flag is reset at "1" in the step S195, and the subroutine for other processes is carried out in the step S196.

Figure 27A:
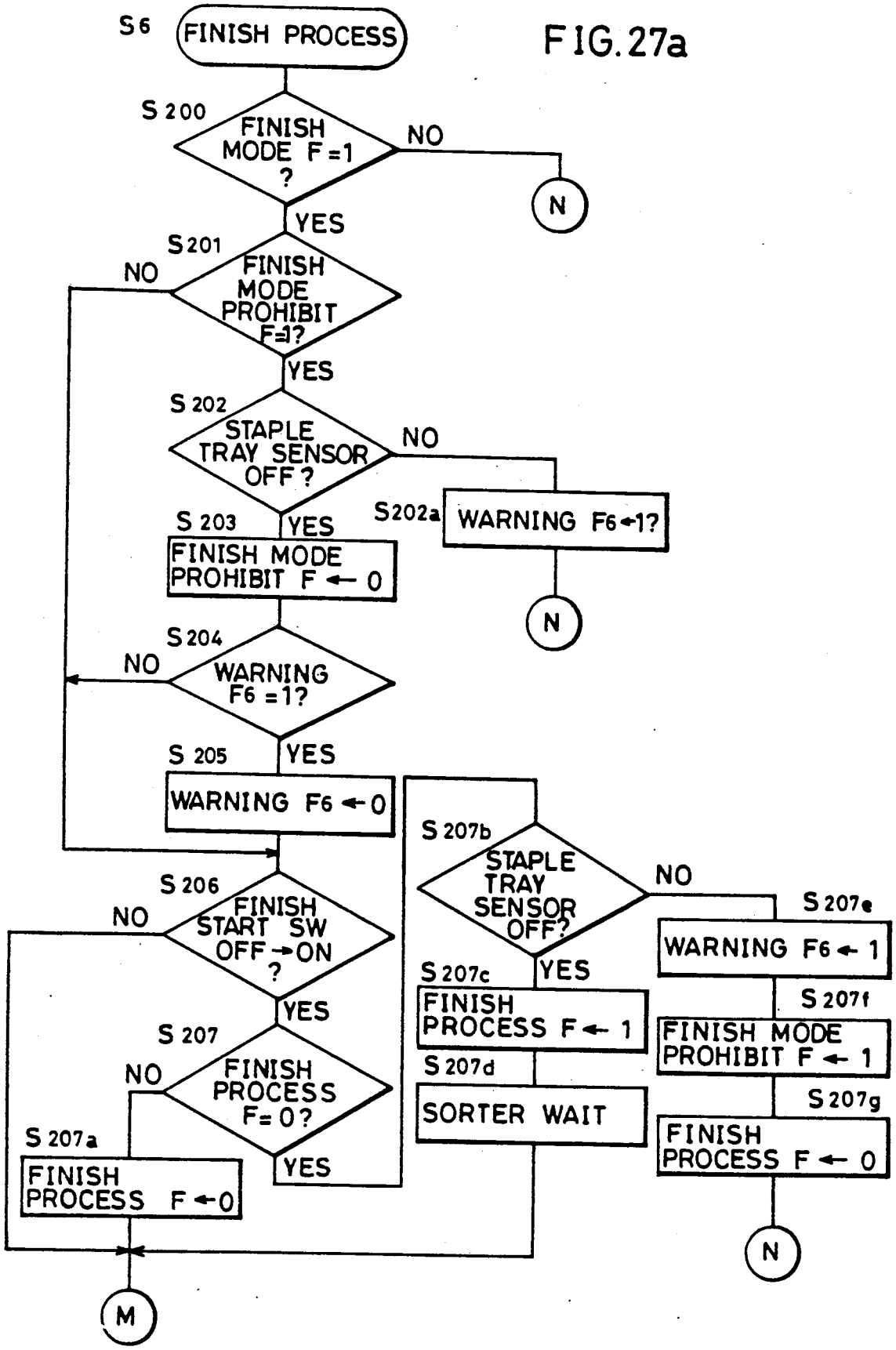
Figure 27B:
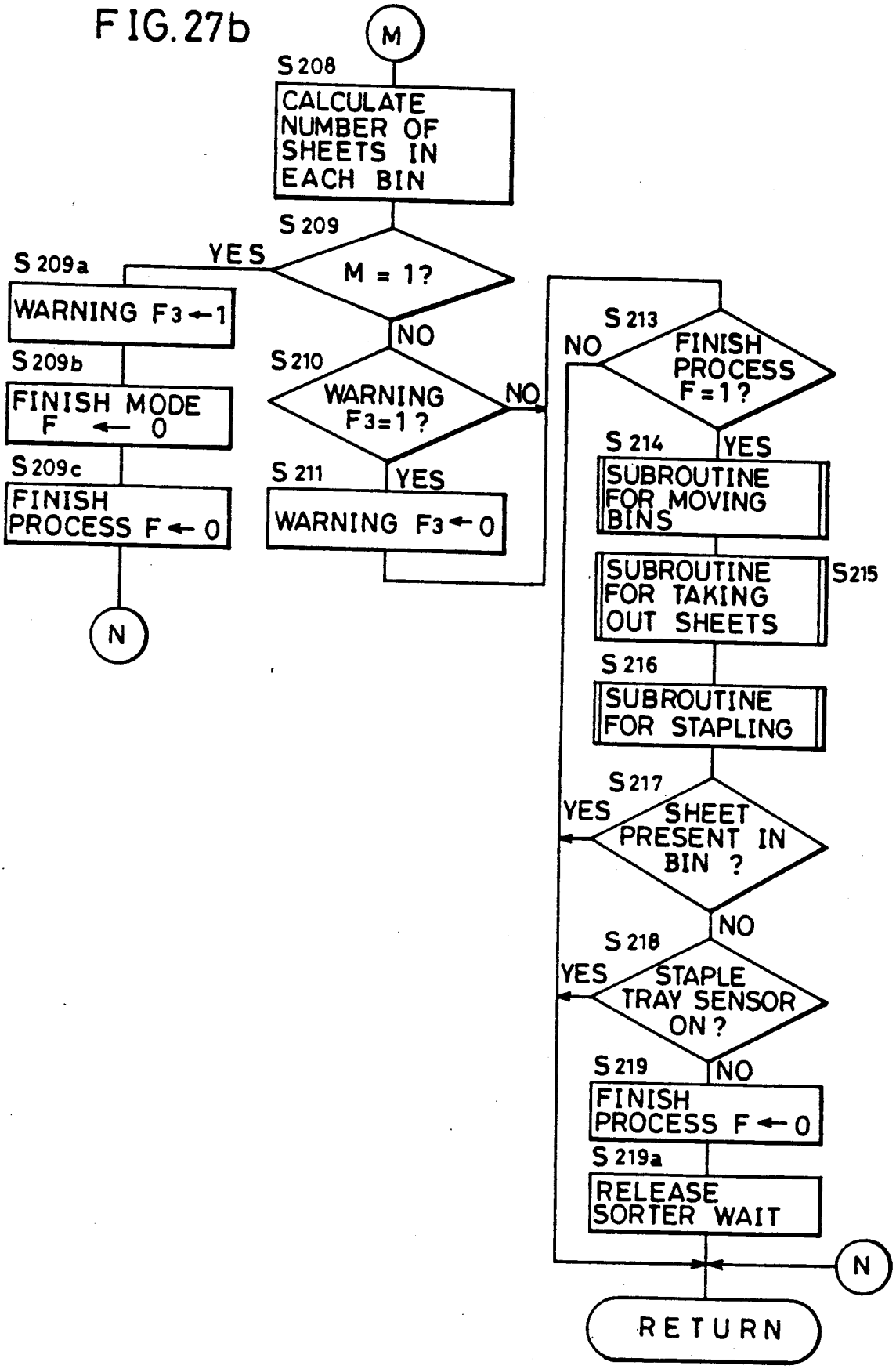

FIGS. 27*a* and 27*b* show a subroutine for the finishing process carried out in the step S6 of the main routine.

First, whether the finish mode flag is "1" or not is checked in the step S200. If it is "0", this subroutine is immediately ended. If it is "1", then whether the finish mode prohibiting flag is "1" or not is checked in the step S201. If it is "0", then the flow proceeds to the step S206. If it is "1", then the presence/absence of a sheet on the staple tray 91 is checked in the step S202 by checking on/off state of the sheet detecting sensor Se6 on the staple tray 91. If the sheet detecting sensor Se6 is on indicating that there is at least one sheet on the tray 91, then there is a possibility of erroneous stapling of the existing sheets with the sheets to be fed to the tray 91 and a possibility of the number for sheets to be stapled exceeding the available number of stapling. Therefor, a warning flag F6 is set at "1" in the step S202*a* to prepare a display of warning indicating that the sheets must be removed from the staple tray 91, and thus the subroutine is ended.

Meanwhile, when it is determined that there is no sheet on the staple tray 91 in the step S202, then the finish mode prohibiting flag is reset at "0" in the step S203, and whether the said warning flag F6 is "1" or not is checked in the step S204. If it is "1", then the warning flag F6 is reset at "0" in the step S205.

Thereafter, whether the finish start switch 158 is turned on or not is checked in the step S206. If it is on, then whether the finish processing flag is "0" or not is determined in the step S207. If it is "1", then the finish process flag is reset at "0" in the step S207*a*. If the finish processing flag is "0", then the presence/absence of a sheet on the staple tray 91 is checked in the step S207*b* based on the on/off state of the sensor Se6. If there is at least one sheet, then the warning flag F6 is set at "1" in the step S207*e* in order to prevent stapling of unnecessary sheets or to prevent excess of the number of sheets as described in the foregoing. The finish mode prohibiting flag is set at "1" in the step S207*f*, the finish process flag is reset at "0" in the step S207*g*, and the subroutine is ended. If there is no sheet in the staple tray 91, then the finish processing flag is set at "1" in the step S207*c*, and the sorter wait is provided in the step S207*d*.

Thereafter, the number of sheets M in each bin is calculated in the step S208, and whether the number of sheets M in each bin is one or not is determined in the step S209. Namely, when each bin 60 comprises one sheet, the stapling operation is unnecessary. Therefore, when it is determined that each bin contains one sheet in the step S209, then a warning flag F3 is set at "1" in the step S209*a* to prepare a display of finish mode unavailable, the finish mode flag is reset at "0" in the step S209*b* to cancel the finish mode, and the finish process flag is reset at "0" in the step S209*c*.

If the number of sheets M in each bin is more than 1, then whether the warning flag F3 is "1" or not is determined in the step S210. If it is "1", then the warning flag F3 is reset at "0" in the step S211. Thereafter, whether the finish processing flag is "1" or not is checked in the step S213. The finishing operation is not started until this flag is set at "1". More specifically, the subroutine for the bin moving process is carried out in the step S214, the subroutine for taking out the sheets is carried out in the step S215 and a subroutine for the stapling operation is carried out in the step S216. When these processes are finished, the presence/absence of the sheet in the bin 60 is checked in the step S217 and the presence/absence of the sheets on the staple tray 91 is checked in the step S218. If it is determined that there is no sheet either in the bin 60 or in the staple tray 91 in the steps S217 and S218, then the finish processing flag is reset at "0" in the step S219, and the sorter wait is released in the step S219*a*.

Now, in the subroutine of the finish process, the prohibition of the finish mode is released by the following operation, i.e., detecting that the sheets have been removed from the staple tray 91 in the step S202, resetting the finish mode prohibiting flag at "0" in the step S203 and resetting the warning flag F6 at "0" in the step S205. The finishing process is re-started by an input of the finish start switch 158. However, the process may be automatically re-started in accordance with the operation of a timer after the release of the prohibition of the finish mode.

Figure 28:
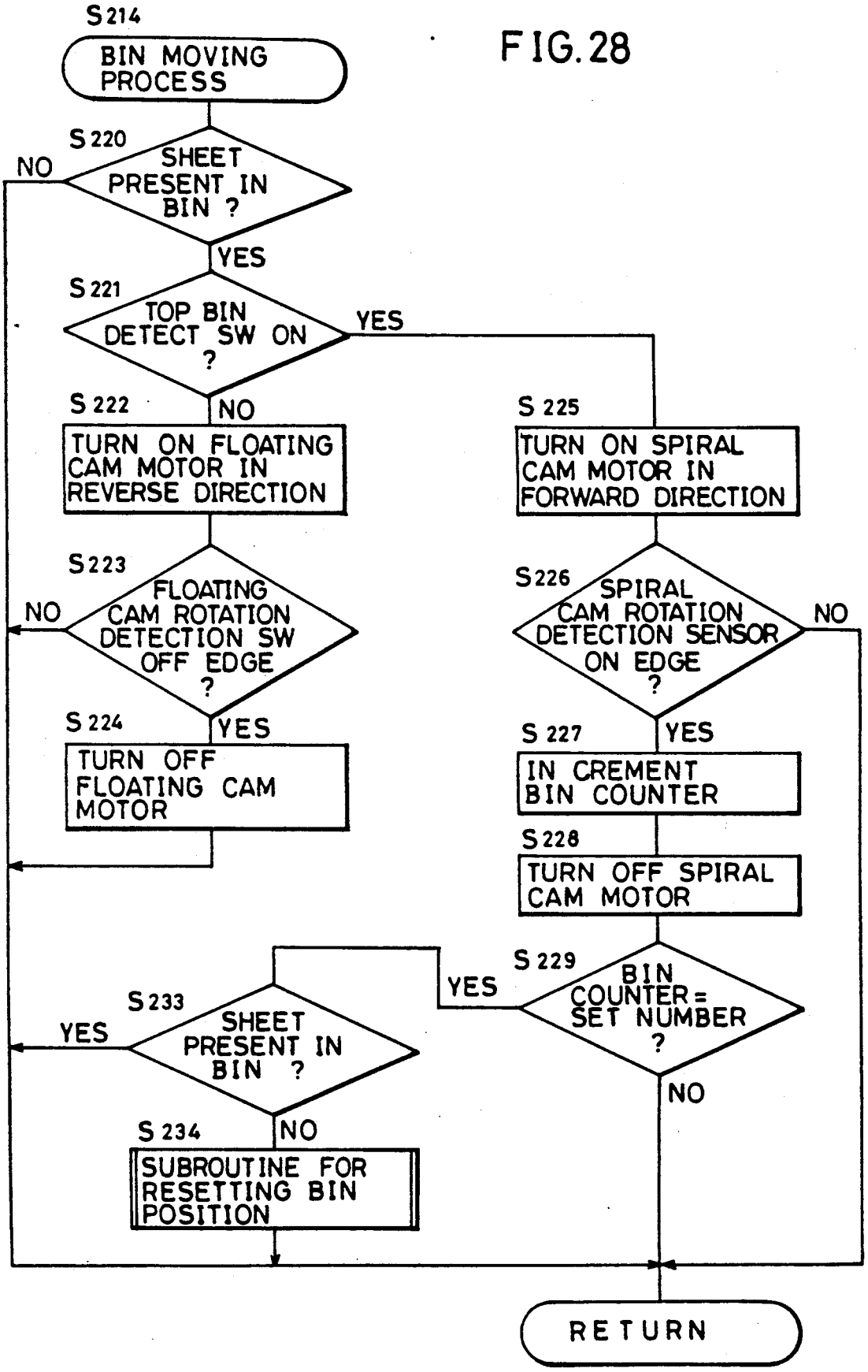

FIG. 28 shows a subroutine of the bin moving process executed in the step S214.

First, the present/absence of the sheets in the bin 60 is checked in accordance with the on/off state of the sensor Se5 in the step S220. If there is no paper, this subroutine is immediately ended. Normally, there is no possibility of such situation. However, this may occur when the operator takes out the sheets from the bin 60 immediately after the copying operation. If there are sheets in the bin, then whether the top bin detecting switch SW2 is on or not is determined in the step S221. If the switch SW2 is not on, then the motor of the floating cam 60 is rotated in the reverse direction in the step S222 in order to move the floating cam 50 to the top bin position $X_2$. When an off edge of the floating cam rotation detecting switch is detected in the step S223, then the motor is turned off in the step S224. These steps S222, S223 and S224 are continued until the floating cam 50 reaches the top bin position $X_2$.

When the floating cam 50 reaches the top bin position $X_2$, that is, when it is determined that the top bin detecting switch SW2 is turned on in the step S228, then the spiral cam motor is rotated in the forward direction in the step S225, and whether there is an on edge of the spiral cam rotation detecting sensor Se2 or not is checked in the step S226. If there is an on edge, it means that the bin 60 at the bottom bin position $X_1$ has been lowered to the position $X_3$ for taking out the sheets. Therefore, the bin counter is incremented in the step S227, and the spiral cam motor is turned off in the step S228.

Thereafter, whether the number of the bin counter is equal to the set number A (see step S10) or not is checked in the step S229. If the number of the bin counter is smaller than the set number A, then the flow once returns to the main routine for the next bin moving process. The above described steps S225 to S228 is repeated for the same number of times as the set number A, and when the number of the bin counter becomes equal to the set number A, it is determined that all the bin moving processes are completed. Therefore, after it is checked that there is no sheet in the bin 60 in the step S233, a subroutine for resetting the bin position is carried out in the step S234.

In the stapling process after the movement of the bin, the floating cam 50 is set at the top bin position $X_2$, so that the sheets can be contained in the uppermost bin 60. Therefore, when the copying machine 1 is operated to carry out the next copying operation while the stapling processing is being carried out, the copied sheets are fed to the uppermost bin 60 in the non-sort mode.

Figure 29:
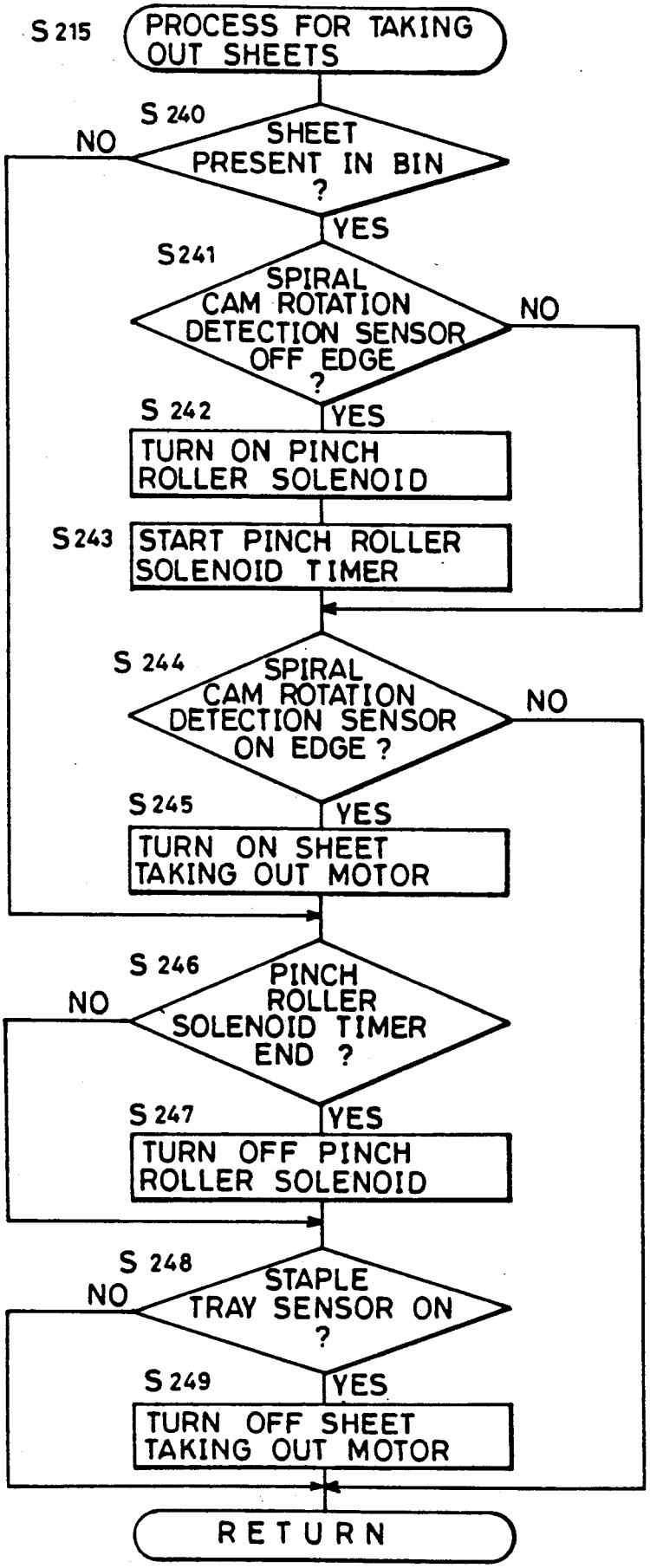

FIG. 29 shows a subroutine for taking out the sheets carried out in the step S215. In this subroutine, the sheets are conveyed from the bin 60 lowered to the position $X_3$ for taking out the sheets to the staple tray 91 through the conveying means 80.

First, whether there are sheets in the bin 60 lowered to the position $X_3$ is checked based on the on/off state of the sensor Se5 in the step S240. When it is determined that there is no sheet, then, appropriate warning is given, although not shown in the flow chart, and the flow proceeds to the step S246. If there are sheets, whether there is an off edge of the spiral cam rotation detecting sensor Se2 or not is checked, that is, whether the spiral cam 70 started the rotation in the forward direction or not is checked in the step S241. When it is determined that there is an off edge, namely, when the spiral cam 70 starts the rotation in the forward direction to lower the bin 60 to the position $X_3$ for taking out the sheets, then the solenoid of the pinch roller 76 is turned on in the step S242, and a pinch roller solenoid timer is started in the step S243. The sheets on the bin 60 are sandwiched between the taking roller 75 and the pinch roller 76 at the position $X_3$ for taking out the sheets, since the solenoid is turned on in the bin 60 when the lowering is started by the forward rotation of the spiral cam 70.

Thereafter, whether there is an on edge of the spiral cam rotation detection sensor Se2, that is, whether the bin 60 has reached the position $X_3$ for taking out the sheets or not is checked in the step S244. If there is an on edge, then a motor for taking out the sheets is turned on in the step S245. Consequently, the sheets are fed to the staple tray 91 by means of the rollers 75, 76, 81*a*, 81*b* and so on. When the end of the operation of the pinch roller solenoid timer is detected in the step S246, then the pinch roller solenoid is turned off in the step S247. Consequently, the pinch roller 76 is displayed upward from the taking roller 76. By doing so, the pinch roller 76 is displaced from the position $X_3$ before the lowering of the next bin 60 from the bottom bin position $X_1$ to prevent interference with the sheets distributed and contained in the bin 60.

Thereafter, when the sensor Se6 of the staple tray 91 is turned on and it is determined that the sheets are fed to the tray 91 in the step S248, the sheet taking motor is turned off in the step S249 and the subroutine is ended.

Figure 30:
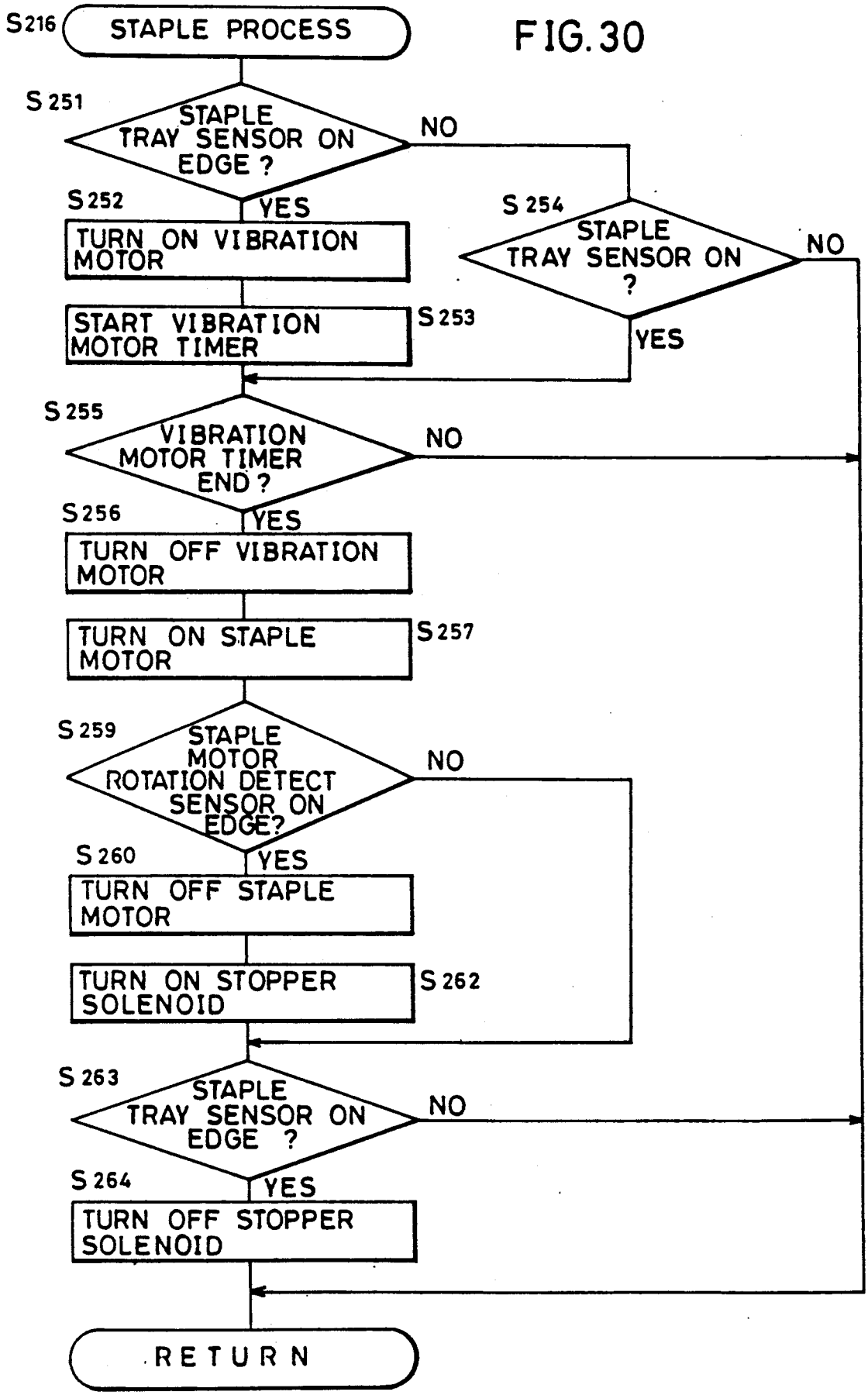

FIG. 30 shows a subroutine of the stapling process executed in the step S216.

First, whether there is an on edge of the sensor Se6 of the staple tray 91 or not is checked in the step S251. This sensor Se6 turns on when a sheet is fed to the tray 91. Therefore, when there is an on edge, a vibration motor 93 is turned on in the step S251 to align the sheets on the tray 91, and the operation of the vibration motor timer is started in the step S253. If it is determined that there is no on edge in the step S251 and it is determined that the sensor Se6 is on in the step S254, namely, when it is determined that the sheets are already contained in the tray 91, then the flow proceeds to the step S255.

When the end of the operation of the vibration motor timer is detected in the step S255, then the vibration motor 93 is turned off in the step S256 and a staple motor is turned on in the step S257. When an on edge of the rotation detecting sensor Se4 of the staple motor is detected in the step S259, that is, when the head 105 is moved to staple the sheets with the staples 106, then the staple motor is turned on in the step S260 and the stopper solenoid is turned on in the step S262. By doing so, the stopper 96 is displaced from the tray 91 and the sheets slide down from the tray 91 to be contained in the stack tray 111.

Thereafter, if an off edge of the sensor Se6 of the staple tray 91 is detected in the step S263, that is, when it is determined that the sheets are discharged to the stack tray 111, then the stopper solenoid is turned off in the step S264 to return the stopper 96 to the tray 91, and the subroutine is ended.

Namely, in the present embodiment, when the finish mode is selected in the subroutine of the sort mode processing (see FIGS. 25*a* and 25*b*), the sheets are distributed from the lower to upper bins (YES in the step S140, steps S142 to 148). On this occasion, when the set number A is smaller than the number of the bins a, then the uppermost bin 60 is not used for the sorting. Therefore, in such case, the operation in the non-sort mode is permitted in the subroutine for setting the sorter mode (see FIG. 20)( steps S40*a*, S40*b* S40*c* and S45). Meanwhile, in the subroutine for moving the bin (see FIG. 28), the floating cam 50 is set at the top bin position $X_2$ so that the sheet can be fed to the uppermost bin 60.

Therefore, when a series of copying operation is completed while the finish mode is being carried out, the next copying operation can be carried out in the non-sort mode during the stapling process.

In addition, in the present embodiment, when the finish mode, in which the stapling process is carried out on the sheets discharged from the copying machine 1, is selected in the subroutine of the copy system processing (see FIGS. 23*a* and 23*b*)(YES in the step S400), then the mode is automatically switched to the AMS mode (step S401) to carry out the copying operation. In the AMS mode, sheets of the same size are copied during a series of copying operation, so that unsatisfactory stapling caused by the existence of the sheets having different sizes can be prevented.

In addition, the most suitable copying magnification rate is calculated (step S404) and if the most suitable copying magnification rate is out of the available range of magnification rate, a warning is given and the system operation, that is, the copying operation, is prohibited (NO in the step S405, steps S407 and S408). Therefore, problems of defective copies in which some portions of the images are out of the sheet, for example, can be prevented and the problem of such defective copies being stapled with other sheets can be prevented.

The copying apparatus in accordance with the present invention is not limited to the above described embodiment, and it can be variously changed and modified in the scope of the spirit of the present invention.

For example, the ADF 30 may be the original circulating type. The ADF is not necessarily be provided. The copying apparatus may be operated not only in the AMS mode and the APS mode but also other copy modes, for example a book copying mode in which images on the pages of a book placed on the platen glass are separately copied on separate sheets of paper, or a mode in which a margin of a prescribed space is provided on an end portion of the sheets.

The present invention may be applied to a sheet containing apparatus which has the stapling function alone as a single unit without the sorter function. The size of the papers which can be stapled is not limited to A4 and B5.

As is apparent from the foregoing, in accordance with the present invention, when a series of copying operation is finished during the finish mode and no sheet is distributed and contained in the uppermost bin, then the next, or second copying operation, which, of course, may include originals having images which are the same as or different from the images copied during the copying operation, is available in the non-sort mode in which the sheets are contained in the uppermost bin. Therefore, the next copying operation can be carried out in parallel to the process of stapling the sheets which were copied last time.

In accordance with another aspect of the present invention, when the finish mode in which the sheets are stapled is selected, the automatic magnification rate selecting function is automatically started to carry out the copying operation. Therefore, there is no possibility of the sheets of different sizes being stapled. Therefore, defective staple operation can be prevented.

In accordance with a further aspect of the present invention, when the finish mode for stapling the sheet is selected, the automatic magnification rate selecting function is started and the calculated magnification rate is out of an available range, then the copying operation is prohibited. Therefore, problems of defective copies, such as a copy in which some portions of the images are out of the sheet, being stapled with other proper copied sheets can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

image forming means for forming images on sheets of paper;

starting means for starting a first image forming operation for forming first images on said sheets of paper;

a plurality of paper containing means for receiving said sheets of paper on which said first images are formed;

sorting means carrying out a sorting operation by distributing said sheets of paper on which said first images are formed into said plurality of paper containing means;

staple means for stapling the sheets of paper contained in each of said plurality of paper containing means after said sorting operation of said sorting means;

determining means for determining whether any one of said plurality of paper containing means is not employed in said sorting operation; and control means for permitting said starting means to start a second image forming operation wherein second images different from said first images are formed on said sheets of paper, and for permitting reception of said sheets of paper on which said second images are formed into said unemployed paper containing means during stapling by said stapling means when it is determined by said determining means that a paper containing means is not employed in said sorting operation.

2. An image forming apparatus according to claim 1, wherein said plurality of paper containing means are arranged successively in a vertical direction, and said sorting means successively distributes said sheets of paper from a lower one to an upper one of said plurality-of paper containing means arranged successively in said vertical direction.

3. An image forming apparatus according to claim 1, wherein said staple means comprises a tray for receiving said sheets of paper and a stapler for stapling said sheets of paper on said tray.

4. A sorter connected to an image forming apparatus which forms images on sheets of paper, and including means for setting the sorting number, said sorter comprising:

a plurality of bins for accommodating said sheets of paper on which images are formed;

distributing means for carrying out a sorting operation by distributing said sheets of paper into said respective bins;

stapling means for stapling said sheets of paper accommodated in each of said plurality of bins in a stapling operation after the end of said sorting operation;

comparison means for comparing said sorting number set by said setting means with the total number of said plurality of bins; and control means for outputting a signal to said image forming apparatus to permit operation of said image forming apparatus simultaneous with said stapling operation when it is determined by said comparison means that said sorting number set by said setting means is smaller than said total number of said plurality of bins.

5. A sorter according to claim 4, wherein said control means further operates to prohibit operation of said setting means when the operation of said image forming apparatus is permitted.

6. A sorter according to claim 5, wherein said image forming apparatus comprises a copying machine.

7. A sorter according to claim 5, wherein said image forming apparatus comprises a printer.

8. A copying apparatus with a photoreceptor capable of reproducing images of an original at different magnification rates on sheets of paper, comprising:

original size detecting means for detecting the size of the original;

paper size determining means for determining the size of the paper;

copying magnification rate setting means for automatically setting a suitable copying magnification rate based on said original size and said paper size;

staple means for stapling said sheets of paper on which said images are formed; wherein said copying apparatus is operated either in a staple mode in which stapling is carried out by the staple means or in a non-staple mode in which stapling is not carried out; said apparatus further comprising means for switching between said staple mode and said non-staple mode; and control means for changing said copying magnification rate to the value set by said copying magnification rate setting means when said staple mode is selected by said switching means.

9. A copying apparatus according to claim 8, further comprising a platen on which the original is placed; and conveying means for conveying said original to said platen; wherein said original size detecting means detects the size of the original when said original is conveyed by said conveying means.

10. A copying apparatus according to claim 8, further comprising paper size setting means for setting a desired paper size, wherein said paper size determining means determines said paper size set by said paper size setting means.

11. A copying apparatus according to claim 8, wherein said staple means comprises paper containing means for containing the sheets of paper on which images are formed and a stapler for stapling said sheets of paper on which said images are formed in said paper containing means.

12. A copying apparatus according to claim 8, further comprising:

copying magnification rate determining means for determining whether said magnification rate set by said magnification rate setting means is in an available range of magnification rate or not; and staple mode prohibiting means for prohibiting execution of said staple mode when it is determined by said magnification rate determining means that said set magnification rate is out of the available range.

13. A copying apparatus with a photoreceptor capable of reproducing images of an original at different magnification rates on sheets of paper, comprising:

original size detecting means for detecting the size of the original;

paper size determining means for determining the size of the paper;

copying magnification rate setting means for automatically setting a suitable copying magnification rate based on said original size and said paper size;

staple means for stapling said sheets of paper on which said images are formed; wherein said copying apparatus is operated either in a staple mode in which stapling is carried out by the staple means or in a non-staple mode in which stapling is not carried out, said copying apparatus further comprising:

switching means for switching between said staple mode and said non-staple mode;

magnification rate determining means for determining whether said magnification rate set by said copying magnification rate setting means is in a prescribed available range of magnification rate or not; and means for prohibiting operation of said staple means when it is determined by said magnification rate determining means that said set magnification rate is out of said prescribed available range 14. A copying apparatus according to claim 13, further comprising:

a platen on which the original is placed; and conveying means for conveying said original to said platen; wherein said original size detecting means detects the size of the original when said original is conveyed by said conveying means.

15. A copying apparatus according to claim 13, further comprising:

paper size setting means for setting a desired paper size, wherein said paper size determining means determines the paper size set by said paper size setting means.

16. A copying apparatus according to claim 13, wherein said staple means comprises paper containing means for containing the sheets of paper on which the images are formed, and a stapler for stapling the sheets of paper on which said images are formed in said paper containing means.

17. A copying apparatus comprising:

a photoreceptor;

a platen on which an original is placed;

projecting means for projecting an image of said original onto said photoreceptor with a prescribed projection magnification rate, said prescribed projection magnification rate being adjustable;

developing means for developing latent electrostatic images formed on said photoreceptor by said projecting means into a toner image;

a plurality of first paper containing means for containing a plurality of sheets of paper having different sizes;

paper size setting means for setting a desired paper size;

supplying means for supplying sheets of paper of the set size from said first paper containing means;

transferring means for transferring said toner image on said photoreceptor to said supplied sheets of paper;

fixing means for fixing said transferred toner image on said sheets of paper;

second paper containing means for containing said sheets of paper on which the images are fixed;

staple means for stapling said sheets of paper contained in said second containing means; wherein said copying apparatus is operated either in a staple mode in which stapling is carried out by said staple means or in a non-staple mode in which stapling is not carried out;

said copying apparatus further comprising:

selecting means for selecting either said staple mode or said non-staple mode;

original size detecting means for detecting the size of the original placed on said platen;

calculating means for calculating a suitable projection magnification rate based on sad set paper size and said detected original size so that said images of the original are included in said sheet of paper; and control means for controlling said projecting means such that said prescribed projecting magnification rate is changed to said suitable projection magnification rate when said staple mode is selected.

* * * * *